US008245830B2

(12) United States Patent
Nireki

(10) Patent No.: US 8,245,830 B2
(45) Date of Patent: Aug. 21, 2012

(54) PAPER CURRENCY HANDLING DEVICE

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 130 days.

(21) Appl. No.: 12/746,664

(22) PCT Filed: Dec. 5, 2008

(86) PCT No.: PCT/JP2008/072185

§ 371 (c)(1),
(2), (4) Date: Jun. 7, 2010

(87) PCT Pub. No.: WO2009/072622

PCT Pub. Date: Jun. 11, 2009

(65) Prior Publication Data

US 2010/0263983 A1 Oct. 21, 2010

(30) Foreign Application Priority Data

Dec. 7, 2007 (JP) ..... 2007-317401

(51) Int. Cl.
*G07F 7/04* (2006.01)
*B65H 31/26* (2006.01)

(52) U.S. Cl. ..... 194/202; 271/220

(58) Field of Classification Search ..... 194/202, 194/206, 342, 350; 271/3.01, 3.02, 3.04, 271/3.13, 207, 220; 235/379; 209/534; 902/9–13; 108/53.1, 106, 144.11; 414/788.1
See application file for complete search history.

(56) References Cited

U.S. PATENT DOCUMENTS

| | | | | |
|---|---|---|---|---|
| 4,722,519 | A * | 2/1988 | Zouzoulas | 271/181 |
| 4,731,523 | A * | 3/1988 | Kozima | 235/379 |
| 5,286,017 | A * | 2/1994 | Hawk et al. | 271/303 |
| 7,172,193 | B2 * | 2/2007 | Cost et al. | 271/180 |
| 2009/0026037 | A1 * | 1/2009 | Yoshioka | 194/350 |

FOREIGN PATENT DOCUMENTS

| | | |
|---|---|---|
| JP | 6 44439 | 2/1994 |
| JP | 11 86079 | 3/1999 |
| JP | 3000328 | 1/2000 |
| JP | 2006 302236 | 11/2006 |

* cited by examiner

*Primary Examiner* — Mark Beauchaine
(74) *Attorney, Agent, or Firm* — Edwards Wildman Palmer LLP

(57) ABSTRACT

Provided is a bill processing apparatus capable of preventing a bill contained in a bill housing part from being drawn out. The bill processing apparatus comprises: an insertion slot (5), into which the bill is inserted; a bill housing part (100) capable of housing the bill inserted from the insertion slot (5); an opening (110A), through which the bill housing part (100) receives the bill; and a pressure plate (115) capable of passing through the opening (110A) to house the bill in the bill housing part (100). The bill processing apparatus further comprises a sensor to detect the bill inserted into the insertion slot (5), so that the pressure plate (115) is moved to regulate the passage of the bill from the opening (110A) till the insertion of the bill is detected by the sensor.

6 Claims, 23 Drawing Sheets

PAPER CURRENCY HANDLING DEVICE

FIELD OF THE INVENTION

The present invention relates to a bill processing apparatus (or paper currency handling device) which prevents an action of drawing out a bill.

BACKGROUND ART

In general, a bill processing apparatus is incorporated into a service device such as a game medium rental machine installed in a game hall, a vending machine or a ticket-vending machine installed in a public space, or the like, which identifies the validity of a bill inserted from an insertion slot by a user and provides various types of products and services in accordance with a value of the bill having been judged as valid. Such a bill processing apparatus comprises a conveyance mechanism that conveys a bill inserted into an insertion slot, a bill identification part that conducts validity judgment whether the bill to be conveyed is valid or not, and a bill housing part (may also be referred to as a safe) that contains bills having been validated as are stacked sequentially after judging authenticity of the bills.

In the bill processing apparatus described above, after the bill is inserted from the insertion slot, it is necessary to prevent the inserted bill from being drawn out for the purpose of fraudulent activity. For example, a bill processing apparatus, which is provided with a shutter at an insertion slot such that it is prevented that a bill having been inserted through the insertion slot is drawn out by closing the insertion slot with the shutter after the insertion, is disclosed in Patent Document 1. In this bill processing apparatus, the bill inserted into the insertion slot is housed in a bill housing part after the bill is judged to be authentic. More specifically, a presser plate that is reciprocated as it passes through an opening is disposed inside the bill housing part, and a bill pushed by the presser plate passes through the opening as it bends flexibly and it is then loaded onto and housed at a predetermined position of the bill housing part.

Patent Document 1: Japanese patent No. 3000328

DISCLOSURE OF THE INVENTION

Problem to be solved by the Invention

A bill processing apparatus, which is capable of more surely preventing a bill housed in a bill housing part from being drawn out, is provided.

Means to Solve the Problem

In the present invention, a bill processing apparatus comprises an insertion slot, into which a bill is inserted, a bill housing part being capable of housing the bill inserted from the insertion slot, an opening for receiving the bill into the bill housing part, and a presser plate, being capable of passing through the opening such that the bill is housed in the bill housing part, and the apparatus further comprises a sensor detecting the bill inserted into the insertion slot such that the presser plate is moved to regulate passage of the bill through the opening until the insertion of a bill is detected by the sensor. Further features of the present invention, its nature, and various advantages will be more apparent from the accompanying drawings and the following description of the preferred embodiment.

DESCRIPTION OF NOTATIONS

Figure 1:
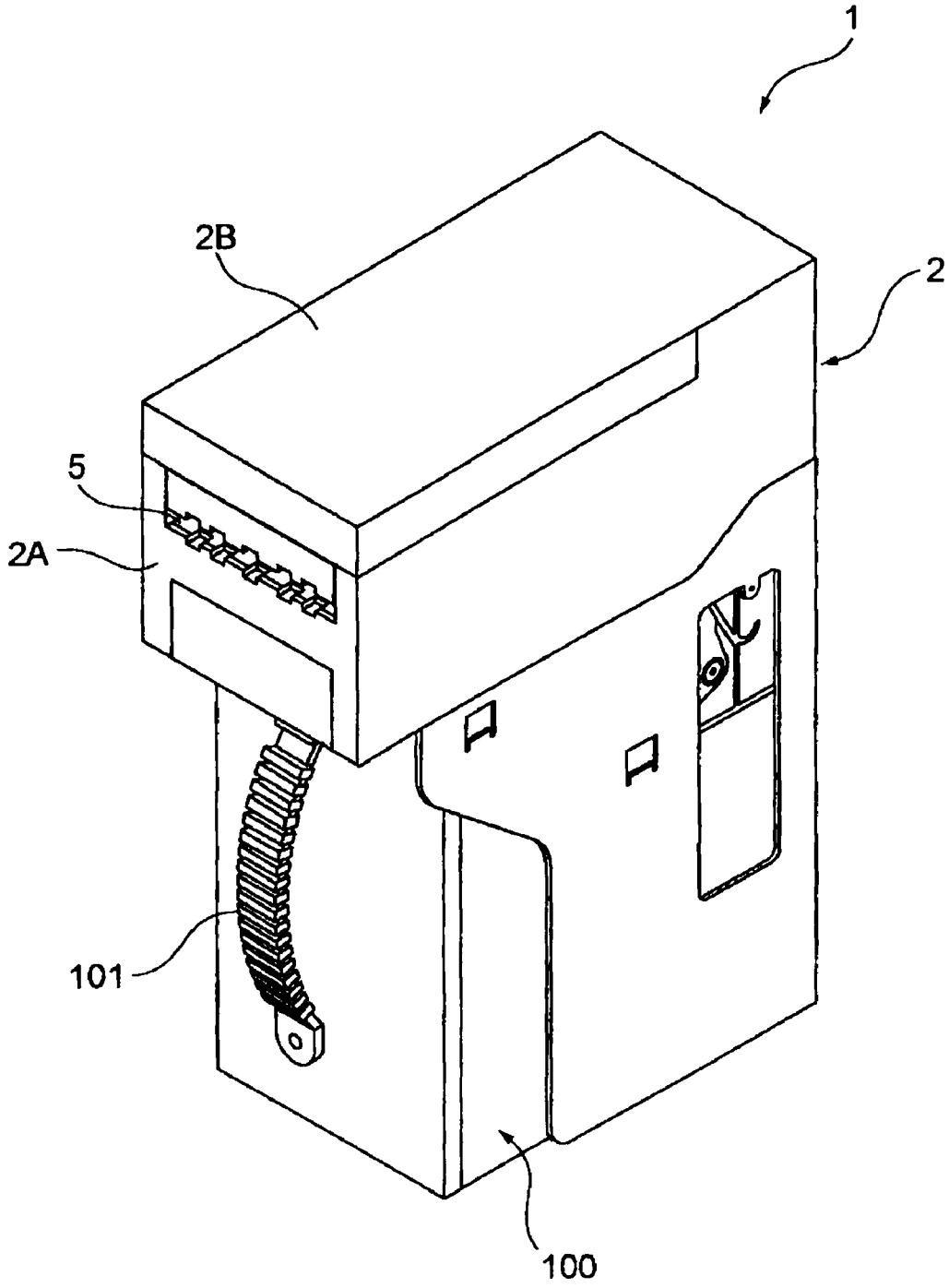
FIG. 1 is a perspective view showing an entire structure to illustrate a configuration of a bill processing apparatus of this embodiment.

1 bill processing apparatus
2 apparatus main body

2A frame
3 bill traveling route
5 bill insertion slot
6 bill conveyance mechanism
8 bill reading means
10 skew correction mechanism
23 detection means
40 driving source
100 bill housing part
103 receiving port
105 placing plate
108 press standby part
110 regulatory member
110A opening
115 presser plate
120 presser plate driving mechanism
122 movable member
122A rack
124A pinion
180 regulatory piece
200 control means

BEST MODE FOR CARRYING OUT THE INVENTION

Figure 2:
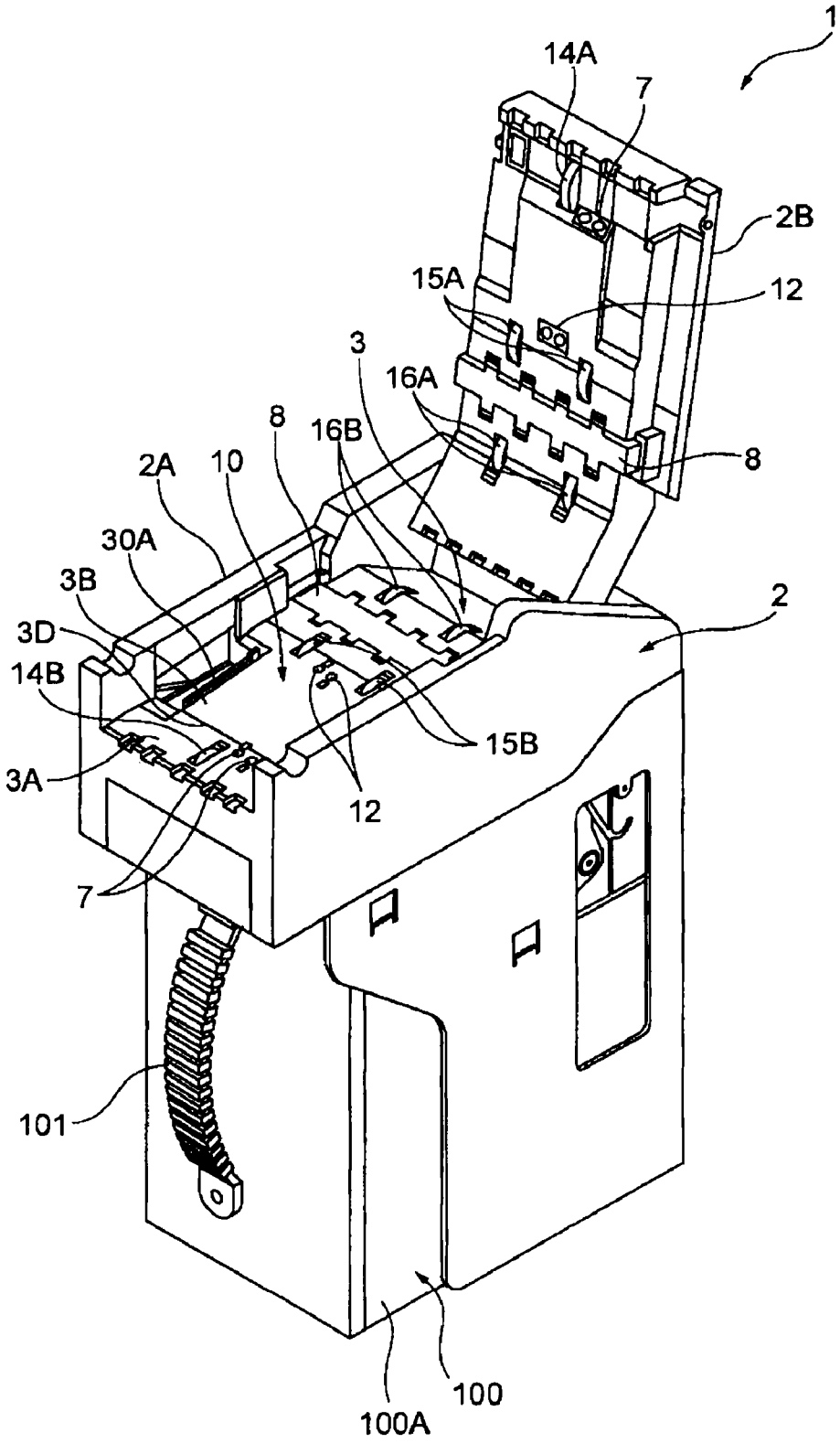
FIG. 2 is a perspective view showing the bill processing apparatus in a state that an open/close member is opened with respect to a main body frame of an apparatus main body.
Figure 3:
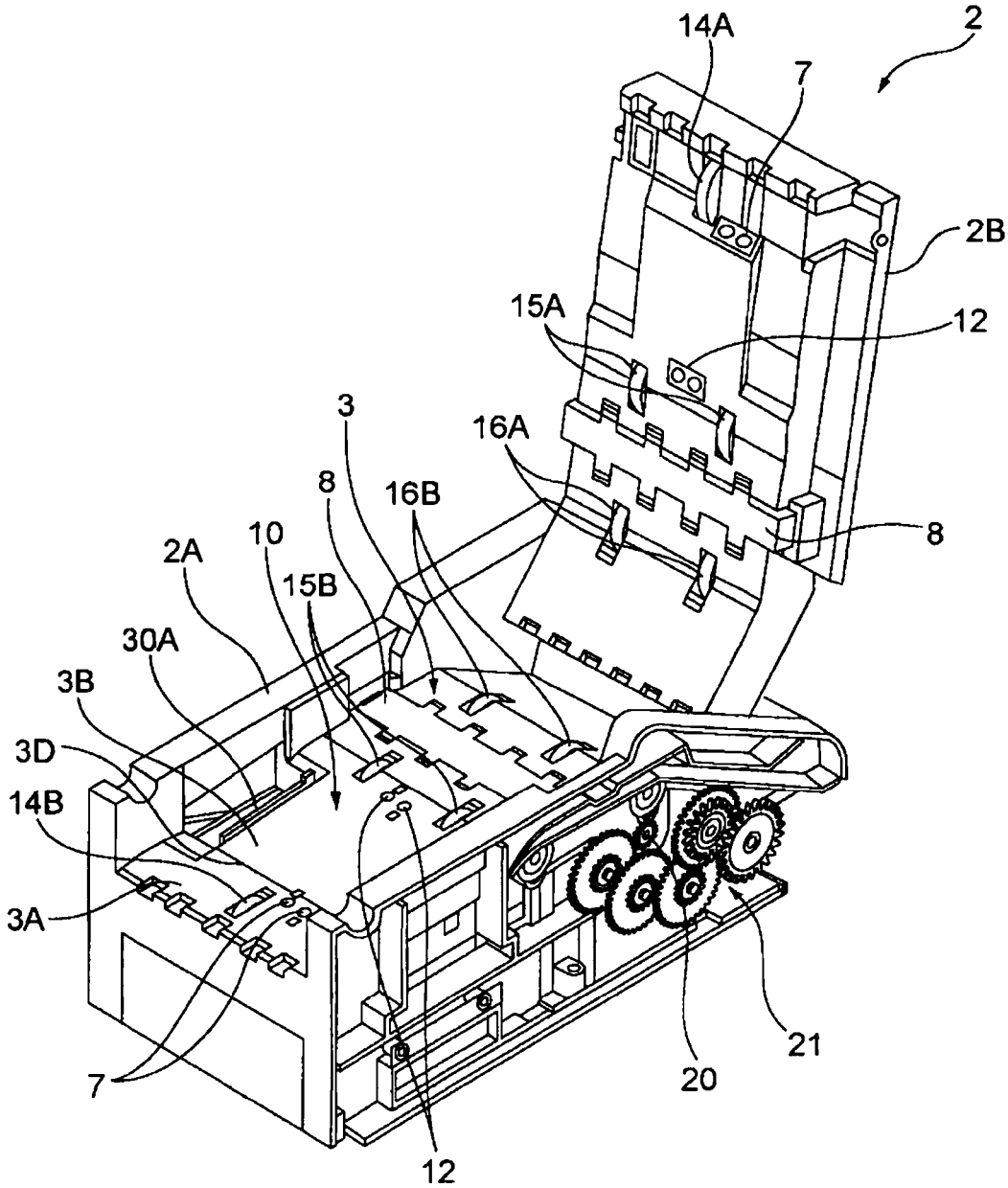
FIG. 3 is a perspective view showing a configuration of a power transmission part of the apparatus main body.
Figure 4:
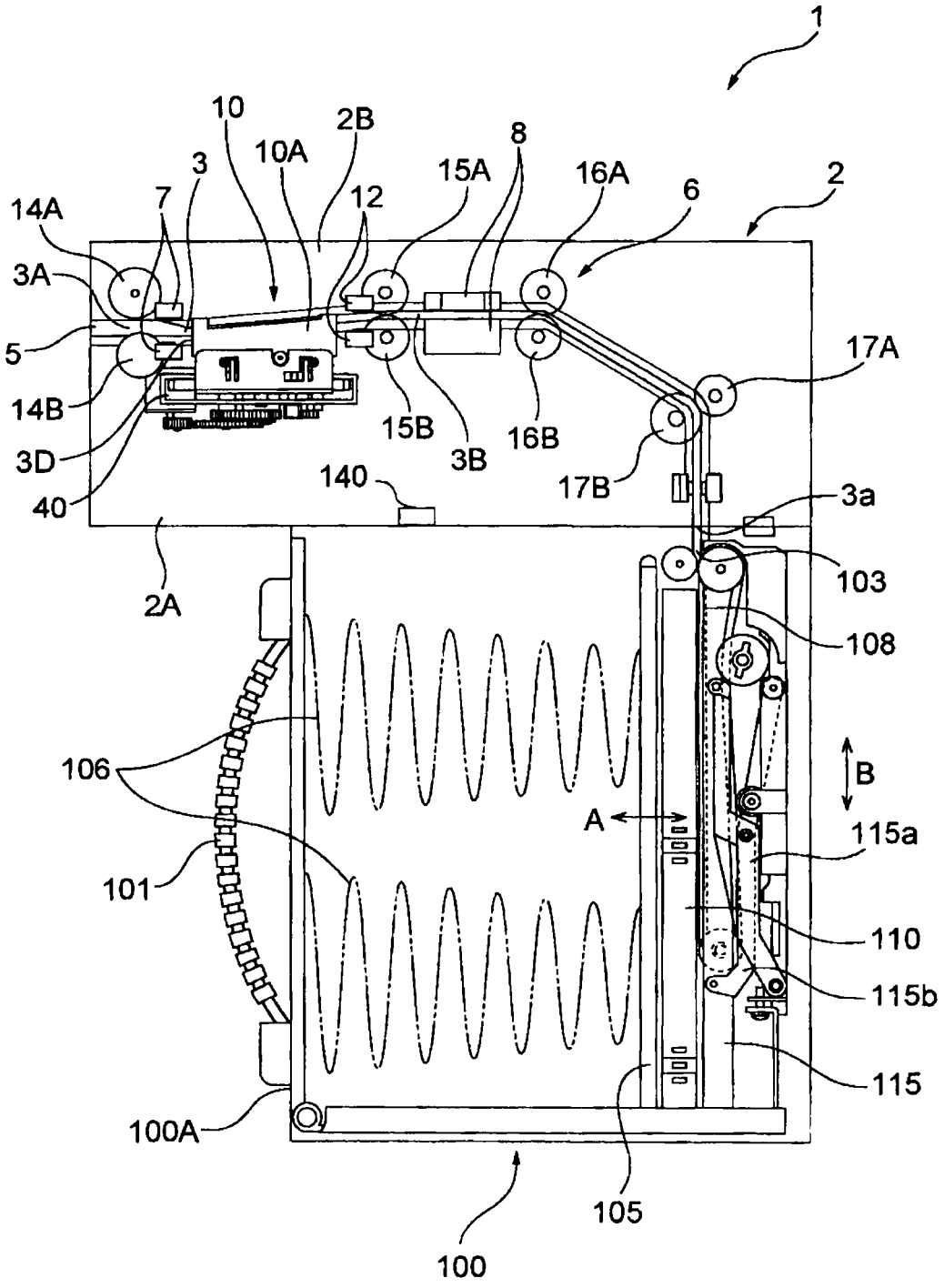
FIG. 4 is a right side view schematically showing a traveling route of a bill to be inserted from an insertion slot.
Figure 5:
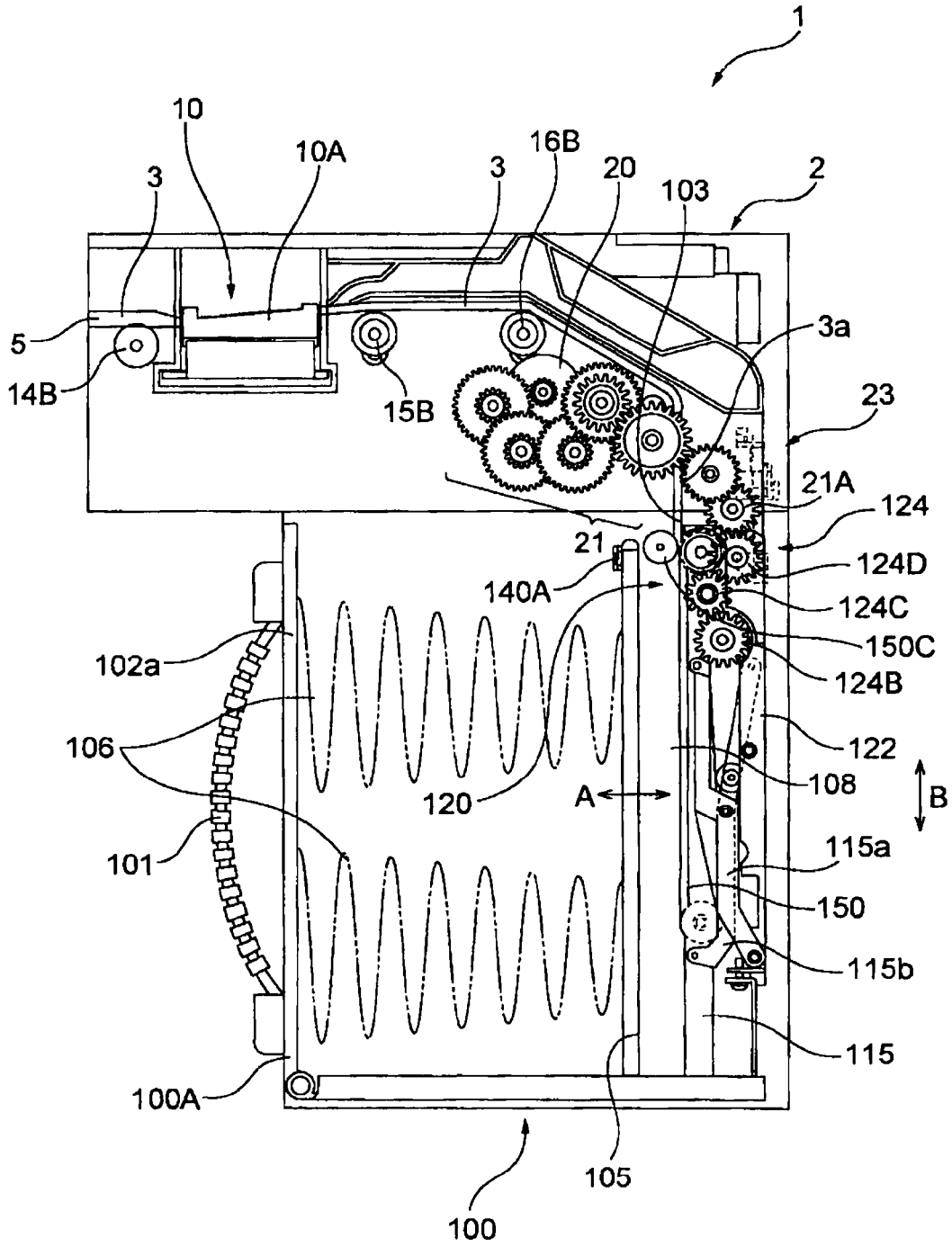
FIG. 5 is a view showing a schematic configuration of a power transmission mechanism for driving the presser plate arranged in a bill housing part.
Figure 6:
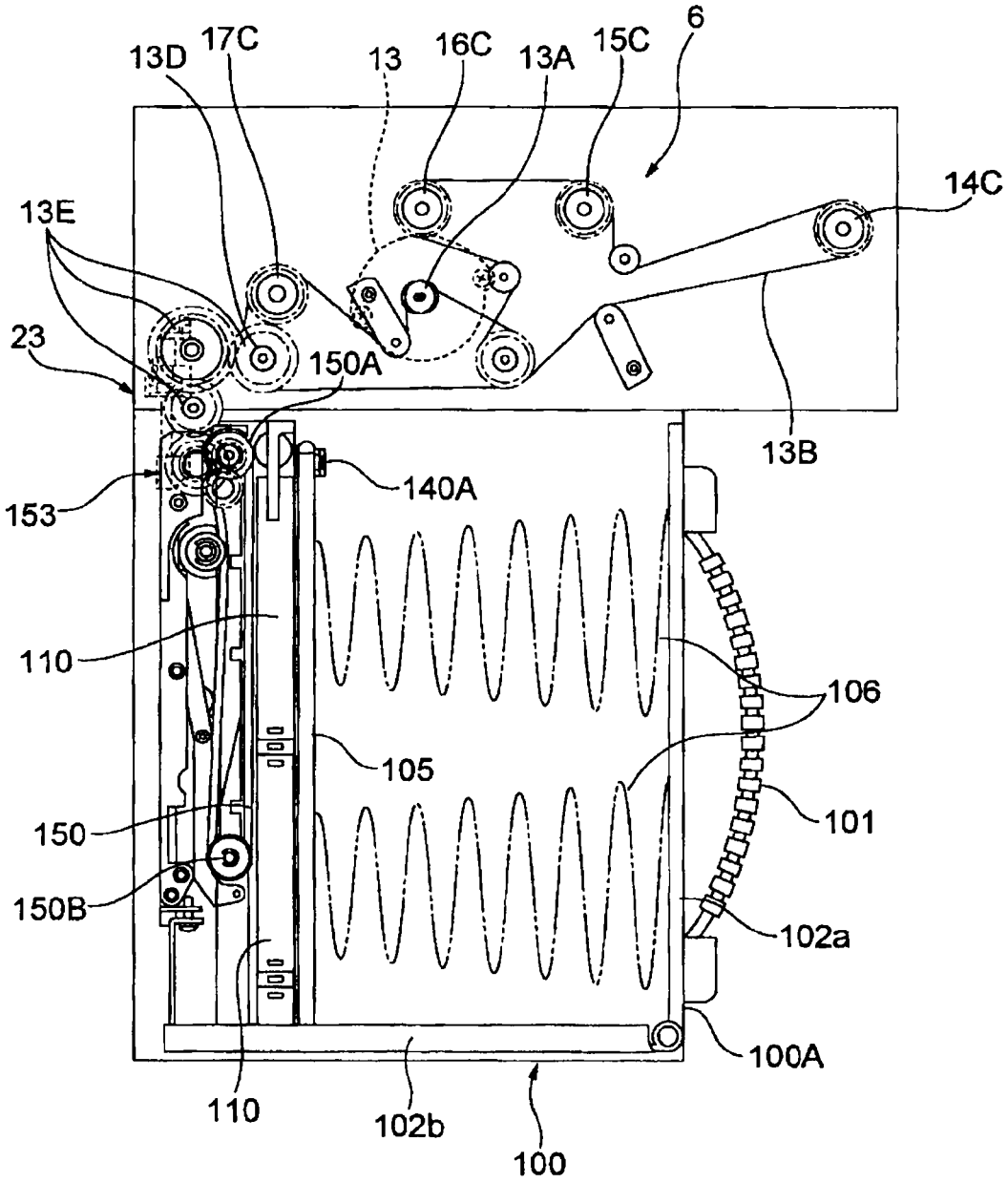
FIG. 6 is a left side view showing a schematic configuration of a driving source and a driving force transmission mechanism to drive a bill conveyance mechanism.

FIGS. 1 to 6 are diagrams showing the configuration of a bill processing apparatus as one of the embodiments according to the present invention. FIG. 1 is a perspective view showing an entire configuration thereof, FIG. 2 is a perspective view showing a state that an open/close member is opened for a main body frame of an apparatus main body, FIG. 3 is a perspective view showing a configuration of a power transmission part of the apparatus main body, FIG. 4 is a right side view schematically showing a traveling route of a bill inserted from an insertion slot, FIG. 5 is a view showing a schematic configuration of a power transmission mechanism to drive a presser plate disposed in a bill housing part, and FIG. 6 is a left side view showing a schematic configuration of a driving source and a driving force transmission mechanism to drive a bill conveyance mechanism.

A bill processing apparatus 1 of this embodiment is configured to be incorporable into, for example, various types of gaming machines such as slot machines, and the bill processing apparatus 1 includes an apparatus main body 2 and a bill housing part (bill housing stacker) 100 which is provided on the apparatus main body 2, and is capable of stacking and housing a great number of bills. The bill housing part 100 has a function as a safe and is configured to be mountable to and demountable from a frame 2A constituting the apparatus main body 2. In this embodiment, for example, it is possible to remove the bill housing part 100 from the frame 2A of the apparatus main body 2 by pulling a handle 101 fixed to a front face thereof in a state that a lock mechanism (not shown) is unlocked.

As shown in FIGS. 2 and 3, the apparatus main body 2 has the frame 2A and an open/close member 2B configured to be opened and closed for the frame 2A by rotating around an axis positioned at one end thereof as a rotating center. Then, as shown in FIG. 4, the frame 2A and the open/close member 2B are configured to form a space (bill traveling route) 3 through which a bill is carried such that both face with each other across the space when the open/close member 2B is closed for the frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

In the apparatus main body 2, a bill conveyance mechanism 6 that conveys a bill; an insertion detecting sensor 7 that detects the bill inserted into the bill insertion slot 5; bill reading means 8 that is installed on a downstream side of the insertion detecting sensor 7, and reads information from the bill in a travelling sate; a skew correction mechanism 10 that accurately positions and conveys the bill with respect to the bill reading means 8; a movable piece passage detecting sensor 12 that detects that the bill passes through movable pieces constituting the skew correction mechanism 10; a discharge detecting sensor 18 that detects that the bill is discharged into the bill housing part 100; detection means 23 for detecting a position of a presser plate 115 pressing the bill toward a placing plate 105 in the bill housing part 100; and control means 200 (a control circuit board 200A; refer to FIG. 16) for controlling the driving of the bill conveyance mechanism 6, the bill reading means 8, the skew correction mechanism 10, and the detection means 23 are provided.

Hereafter, the respective components described above will be described in detail.

The bill traveling route 3 is extended from the bill insertion slot 5 toward the back side, and is formed to be bent so as to be inclined downward on its rear side, and to be eventually bent in the vertical direction. A discharge slot 3*a* from which the bill is discharged into the bill housing part 100 is formed in the bill traveling route 3, and the bill discharged therefrom is fed into a feed port (receiving port) 103 of the bill housing part 100 in the vertical direction.

The bill conveyance mechanism 6 is a mechanism capable of carrying the bill inserted from the bill insertion slot 5 along the insertion direction, and of carrying back the bill in an insertion state toward the bill insertion slot 5. The bill conveyance mechanism 6 comprises a motor 13 (refer to FIG. 6) serving as a driving source installed in the apparatus main body 2; and conveyor roller pairs (14A and 14B), (15A and 15B), (16A and 16B), and (17A and 17B) which are installed with predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to carry the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7. In addition, the upper conveyor roller 14A is controllably driven to be pressed against or spaced from the conveyor roller 14B by a driving source 70 (refer to a block diagram of FIG. 16). The driving source 70 may comprise a motor, solenoid, and the like, and is installed in the open/close member 2B.

Then, the upper conveyor roller 14A is spaced from the lower conveyor roller 14B so as to release the load on the bill when a process correction process) for positioning the bill for the bill reading means 8 by eliminating tilt of the inserted bill is executed by the skew correction mechanism 10, and the upper conveyor roller 14A is driven to move toward the lower conveyor roller 14B again to nip and hold the bill therebetween when the skew correction process is completed. The skew correction mechanism 10 comprises a pair of right and left movable pieces 10A (only one side is shown) that perform skew correction and the skew correction process is performed by driving a motor 40 for a skew driving mechanism.

The conveyor rollers 14B, 15B, 16B and 17B installed on the underside of the bill traveling route 3 are, as shown in FIG. 6, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in proper places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to carry the bill toward the insertion direction. When the motor 13 is driven to reversely rotate, the conveyor rollers 14B, 15B, 16B, and 17B are driven to reversely rotate in synchronization therewith to carry back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A and 14B) and the skew correction mechanism 10. The insertion detecting sensor 7 comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the bill traveling route 3. The discharge detecting sensor 18 also comprises an optical sensor or a mechanical sensor in the same way as the aforementioned insertion detecting sensor.

The bill reading means 8 reads bill information on the bill carried in a state that the skew is eliminated by the skew correction mechanism 10 (in a state that the bill is accurately positioned), and judges whether the bill is true or false. In detail, for example, the bill reading means 8 may comprise a line sensor that performs reading of the bill such that a bill to be carried is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be carried.

Next, the configuration of the bill housing part 100 will be described with reference to FIGS. 7 to 12 in addition to FIGS. 4 to 6.

Figure 7:
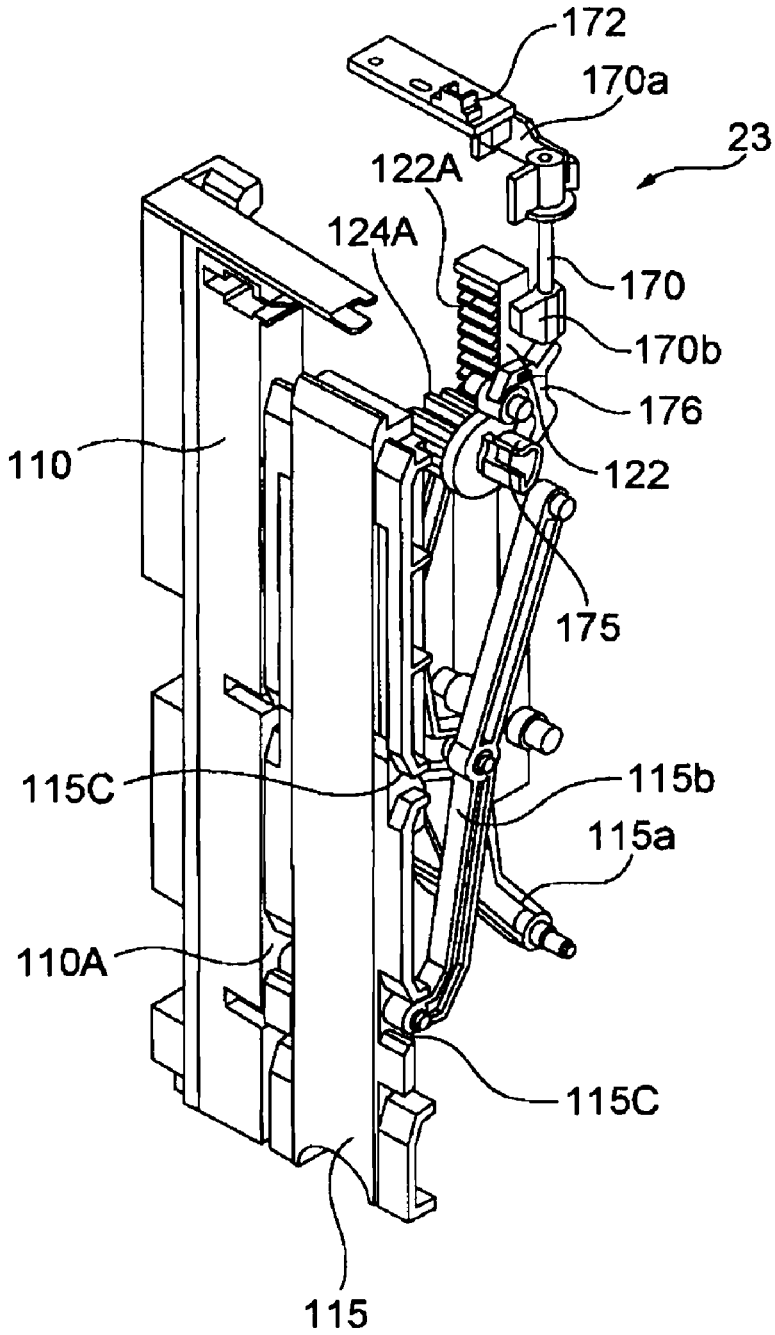
FIG. 7 is a perspective view with some missing parts showing a driving mechanism of the presser plate in a state that the pressure plate is in a standby position.
Figure 8:
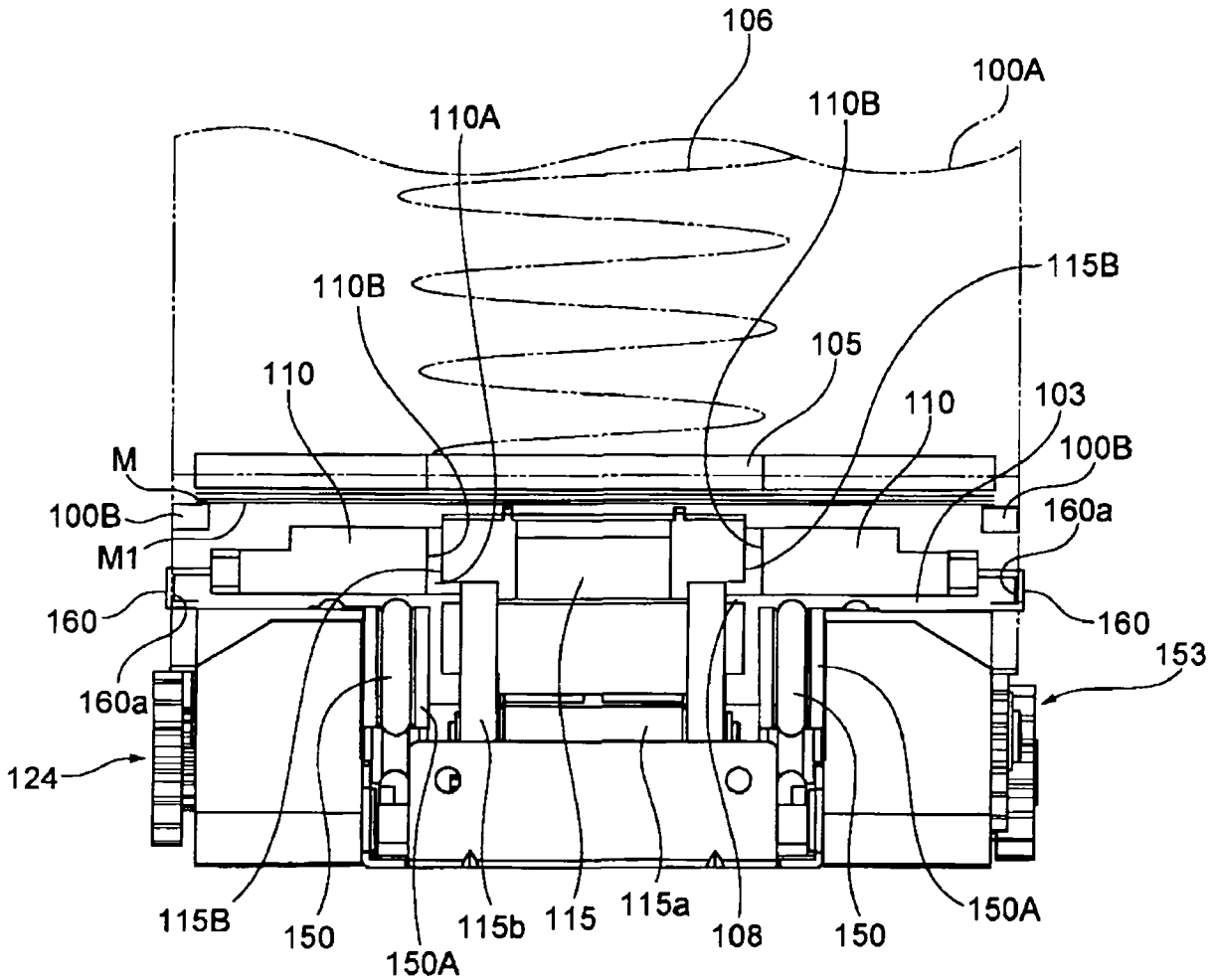
FIG. 8 is a plan view showing a receiving port potion of the bill housing part in such a state as shown in FIG. 7.
Figure 9:
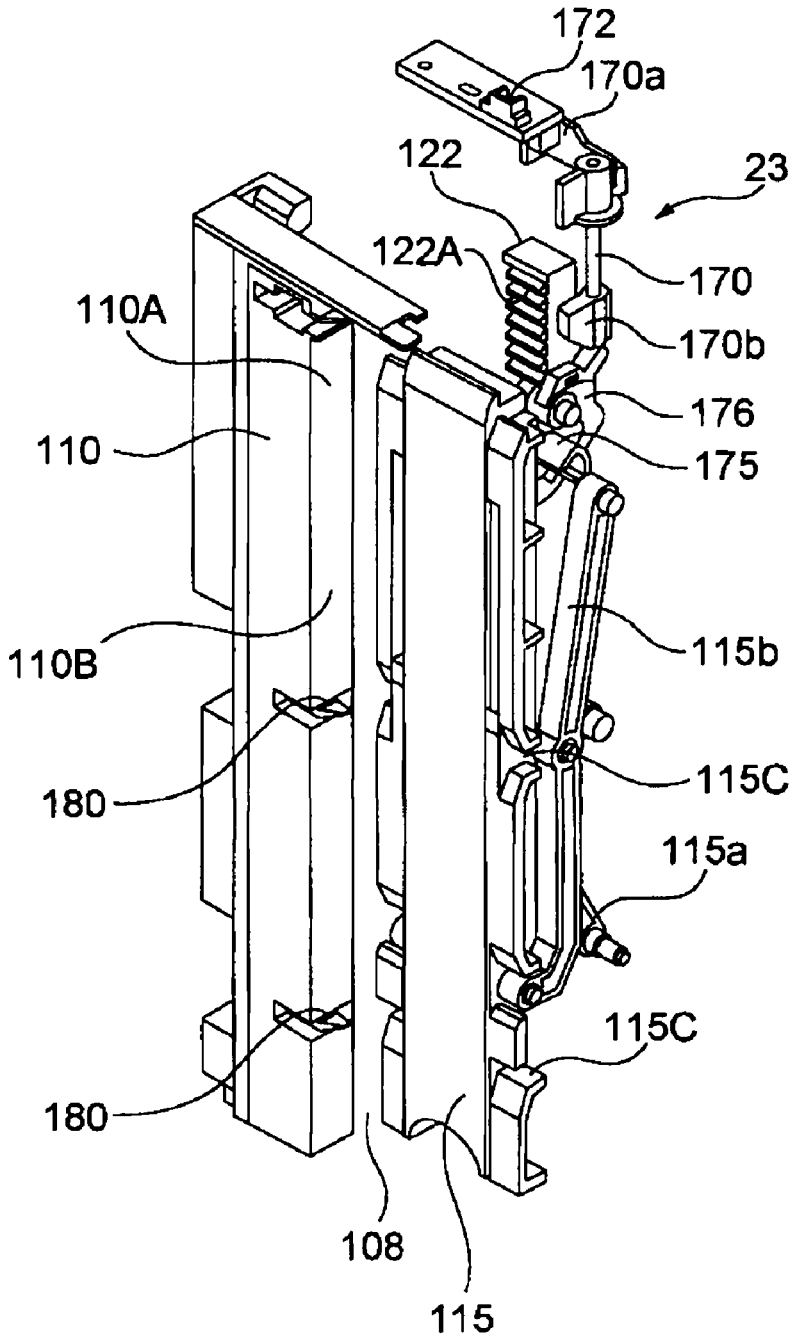
FIG. 9 is a perspective view with some missing parts showing a driving mechanism of the presser plate in a state that the presser plate is in an initial position.
Figure 10:
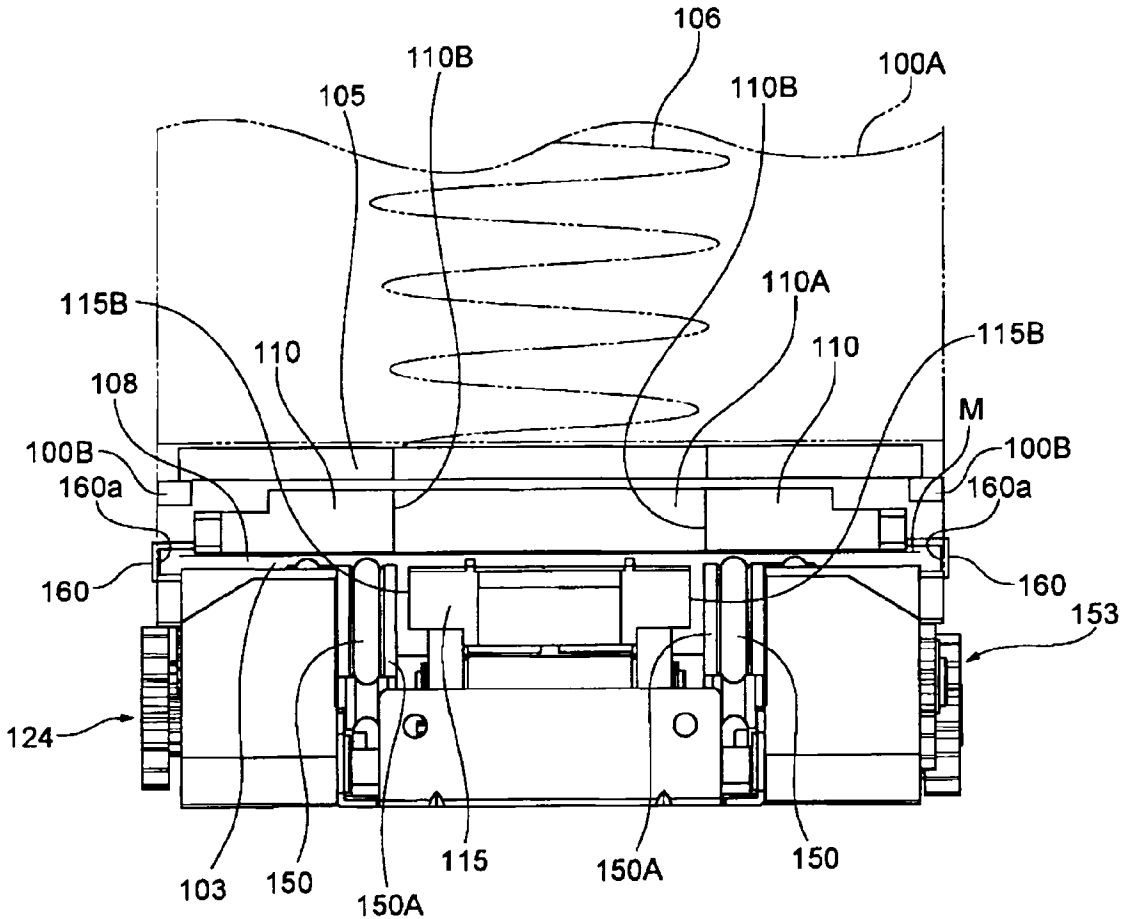
FIG. 10 is a plan view showing the receiving port portion of the bill housing part in such a state as shown in FIG. 9.
Figure 11:
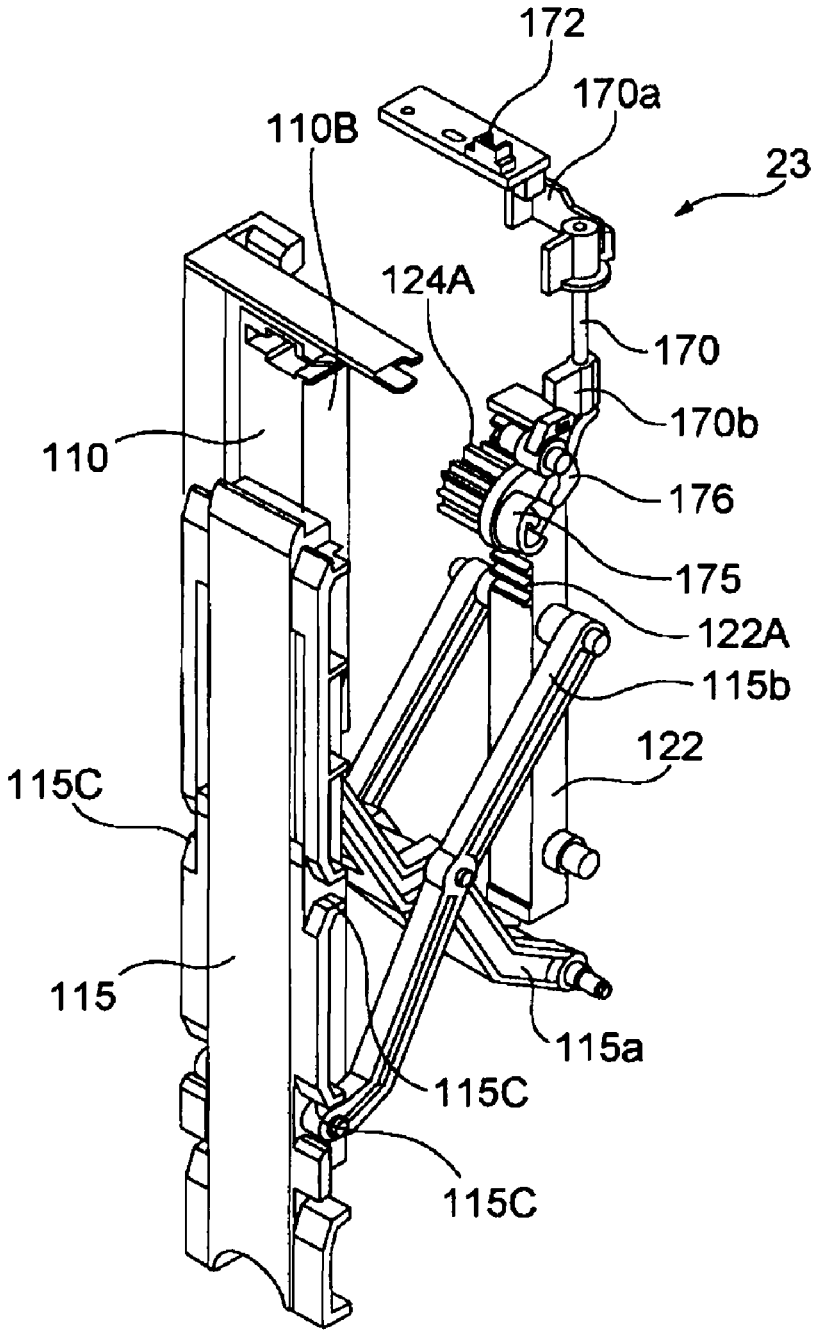
FIG. 11 is a perspective view with some missing parts showing the driving mechanism of the presser plate in a state that the presser plate is in a pressing position.
Figure 12:
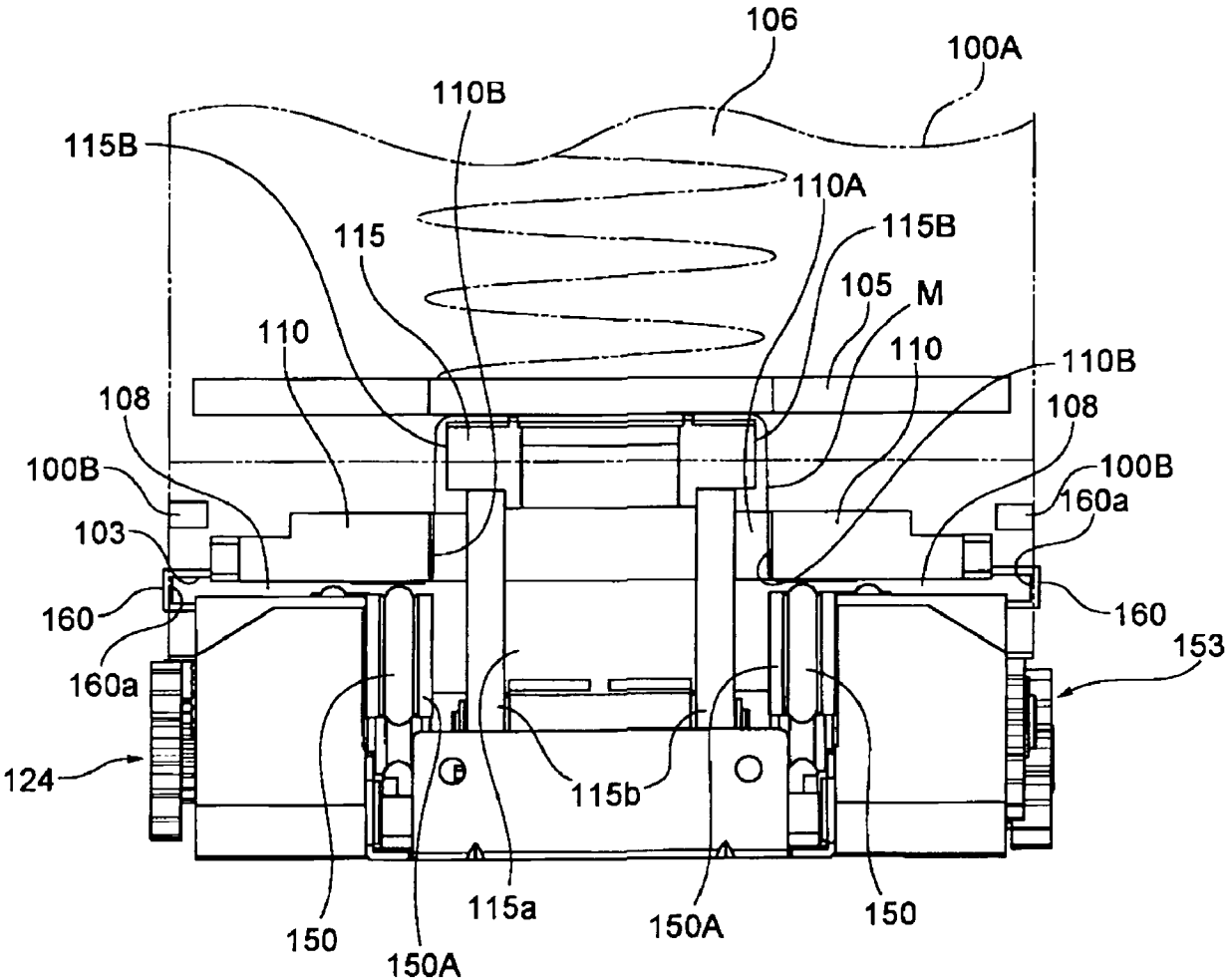
FIG. 12 is a plan view showing the receiving port portion of the bill housing part in such a state as shown in FIG. 11.

In addition, among these drawings, FIG. 7 is a perspective view with some missing parts showing a driving mechanism of the presser plate in a state that the pressure plate is in a standby position, FIG. 8 is a plan view showing a receiving port potion of the bill housing part in such a state as shown in FIG. 7, FIG. 9 is a perspective view with some missing parts showing a driving mechanism of the presser plate in a state that the presser plate is in an initial position, FIG. 10 is a plan view showing the receiving port portion of the bill housing part in such a state as shown in FIG. 9, FIG. 11 is a perspective view with some missing parts showing the driving mechanism of the presser plate in a state that the presser plate is in a pressing position, and FIG. 12 is a plan view showing the receiving port portion of the bill housing part in such a state as shown in FIG. 9.

The bill housing part 100 that houses bills is so configured as to stack and house sequentially the bills identified as being genuine by the bill reading means 8.

As shown in FIGS. 4 to 6, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening 110A, through which the presser plate 115 passes in a process of successively stacking bills onto the placing plate 105, is formed between the pair of regulatory members 110.

Further, protruding walls 100B are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls 100B take a holding role to stably hold the stacked bills by hitting and contacting both sides of a surface of an uppermost bill M1 of the stacked bills (refer to FIG. 8).

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening 110A formed between the pair of regulatory members 110, and gets into the opening 110A so as to be driven to reciprocate between a position where the bills are pressed against the placing plate 105 (a pressing position; refer to FIGS. 11 and 12) and another position where the press standby part 108 is opened (an initial position; refer to FIGS. 9 and 10). Here, the opening 110A has a smaller rectangular shape than the bill guided to the press standby part 108 and the bill passes through the opening 110A as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIG. 5, and these link members 115*a* and 115*b* are connected in a shape of letter "X", and the other ends opposite to the respective ends are supported pivotally by a movable member 122 installed movably in a vertical direction (an arrow B direction). A rack 122A is formed in the movable member 122, and a pinion 124A constituting the presser plate driving mechanism 120 is geared (engaged) with the rack.

As shown in FIG. 5, a housing part side gear train 124 constituting the presser plate driving mechanism 120 is connected to the pinion 124A. In this case, in this embodiment, as shown in FIGS. 3 and 5, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion 124A and gears 1240, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack 122A installed onto the movable member 122, and the link members 115*a*, 115*b*, etc.).

Further, when the above-described presser plate 115 is driven to reciprocate in the arrow A direction by the motor 20, the presser plate 115 is configured to take three positions in accordance with the stop control of the motor 20. Specifically, as shown in FIGS. 9 and 11C, the following three positions may be taken: the pressing position (maximum stroke position) where the bills are pressed against the placing plate 105; the initial position (home position) where the press standby part 108 is opened as shown in FIGS. 9 and 10; and the standby position where the pair of link members 115*a*, 115*b* prevent a bill from being carried into the press standby part 108 from the receiving port 103 such that the pair of link members 115*a*, 115*b* to drive the presser plate 115 are positioned in the press standby part 108 as shown in FIGS. 7 and 8.

Here, when the presser plate 115 is at the standby position, the opening 110A of the regulatory members 110 is caused to be a closed state by the presser plate 115 so that a bill cannot pass through (a bill pressed against the protruding walls 100B by the placing plate 105 cannot pass through the opening 110A) or cannot be drawn out.

In the frame 2A of the main body 2, as shown in FIG. 4, a detecting sensor (full detecting sensor) 140 that detects the state when a predetermined number of bills are placed on the placing plate 105 is installed. The full detecting sensor is configured to be capable of detecting a magnetic signal, and is configured to be capable of detecting a magnetic field by a magnet 140A provided at a center on the rear surface of the placing plate 105. That is, the full detecting sensor 140 is installed at a predetermined position in a direction in which the placing plate 105 is pushed back, bills are sequentially placed on the placing plate 105 such that the placing plate 105 is pushed back against the bias force of the bias means 106, and the full detecting sensor 140 outputs a signal notifying that the bills on the placing plate 105 are full when the full detecting sensor 140 detects a backward movement of the placing plate 105.

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 6, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 17B for conveying the bill by driving the motor 13 to rotate.

In this way, when driving the belts 150 installed in the bill housing part, the motor 13 serving as the driving source of the bill conveyance mechanism 6 provided in the apparatus main body 2 is utilized, thereby reducing the cost.

As shown in FIG. 8, guide members 160 regulating the both side edges of the bill are formed to extend along the conveying-in direction of the bill from the receiving port 103 in the main body frame 100A. The guide members 160 have U-shaped guide faces 160*a* being installed on the lateral end portions and regulating the both side edges of the bill to be conveyed in. The U-shaped guide faces 160*a* are arranged to lie on respective sides such that openings thereof face each other. When the bill is conveyed inside the bill housing part (the press standby part 108) from the receiving port 103, the guide faces 160*a* allow the bill to move along the guide member 160, and the bill and the pair of belts 150 can slidingly contact each other stably. In this way, it is prevented that the bill is shifted on either side when the bill is conveyed into the press standby part 108, thereby making it possible to more reliably convey the bill to an appropriate position.

Detection means 23 being capable of detecting a position of the presser plate 115 is arranged in association with the rack 122A and the pinion 124A that drive the presser plate 115 as described above.

The detection means 23 has a detecting member 170 that is movable according to a movement of the presser plate 115 and a sensor 172 that detects that the detecting member 170 is moved according to the movement of the presser plate 115 to the pressing position.

The detecting member 170 is supported by the frame 2A of the apparatus main body 2 so as to be movable in the vertical direction, and a detecting part 170*a*, which is detectable by the sensor 172, is formed on one end side thereof, and an engaging part 170*b*, which is engageable with a cam member 175 integrally rotated with a pinion 124A via a cam follower 176, is formed on the other end side thereof.

The sensor 172 comprises an optical system sensor element, and as is publicly known, the sensor 172 is configured to operate between a light emitting part and a light receiving part so as to be capable of detecting a movement of the detecting part 170*a* of the detecting member 170. The detecting member 170 is always biased toward the cam follower 176 side by biasing means (not shown), and the movement of the detecting member 170 by a bias force is limited by the engaging part 170*b* formed on the other end side, the cam follower 176, and the cam member 175.

The cam member 175 has such a shape that the detecting member 170 is moved by the cam follower 176 when the presser plate 115 is moved between the pressing position as shown in FIGS. 11 and 12 and the standby position as shown in FIGS. 7 and 8, and that the movement of the detecting member 170 is limited by the cam follower 176 when the presser plate 115 is moved between the standby position as shown in FIGS. 7 and 8 and the initial position as shown in FIGS. 9 and 10.

That is, when the presser plate 115 is moved from the standby position to the initial position, the detecting member 170 does not move due to the shape of the cam 175, the detection thereof by the sensor 172 is not carried out. Further, when the presser plate 115 is moved from the initial position to the pressing position, the detecting member 170 is moved downward by the biasing force of the biasing member 171, and the cam 175 and the cam follower 176, and the movement to the pressing position is detected by the sensor 172. And when the presser plate 115 is moved from the pressing position to the standby position, the detecting member 170 is moved upward by the cam 175 and the cam follower 176, and the movement to the standby position is detected by the sensor 172.

The presser plate 115, which is driven to reciprocate between the initial position and the pressing position by passing through the opening 110A between the pair of regulatory members 110 as described above, is positioned inside the opening 110A and occludes the opening as shown in FIGS. 7 and 8 in the state that the bill housing operation is not being performed and the pair of link members 115*a*, 115*b* that drive the presser plate 115 are positioned inside the press standby part 108. Although, in this state, slight gaps are formed between the inner walls 110B of the regulatory members 110 defining the opening 110A and the side walls 115B of the presser plate 115, in this embodiment, these gaps are filled as shown in FIGS. 13 and 14 to prevent passage of a bill stacked on the placing plate.

Figure 13:
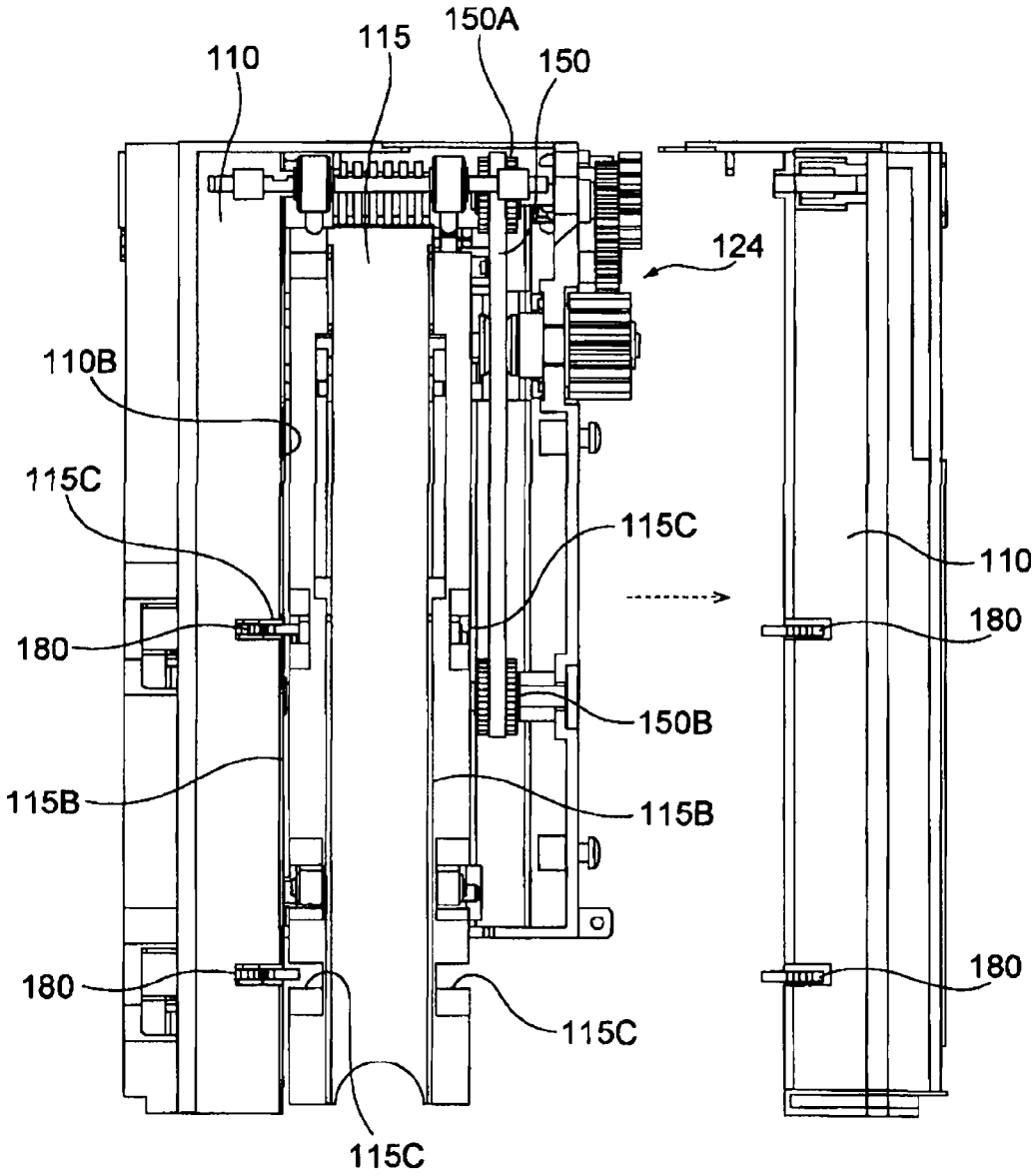
FIG. 13 is a front view showing the presser plate and a pair of regulatory members in a state that a right part of the regulatory members is shifted in a direction shown by a dotted line.
Figure 14:
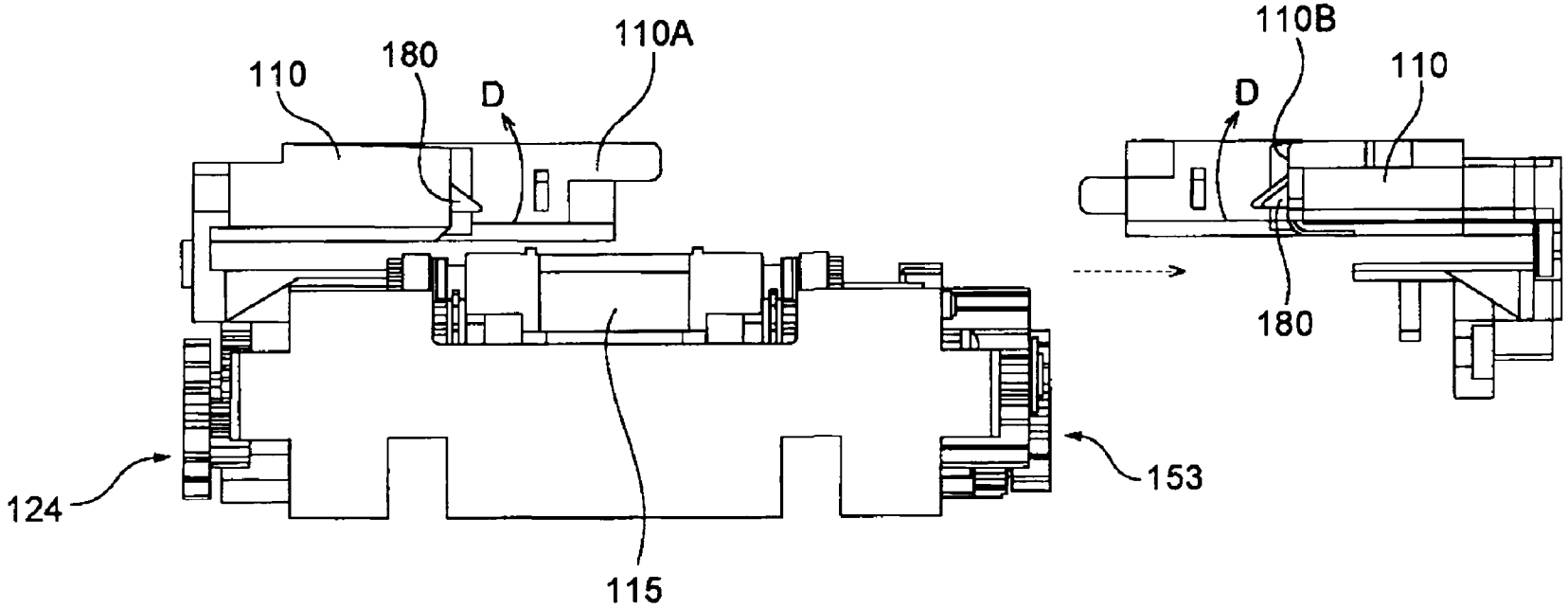
FIG. 14 is a bottom view showing the presser plate and the pair of regulatory members in a state that the right part of the regulatory members is shifted in a direction shown by a dotted line.

FIG. 13 is a front view showing the presser plate and the pair of regulatory members in a state that a right part of the regulatory members is shifted in a direction shown by an arrow depicted in a dotted line, and FIG. 14 is a bottom view showing the presser plate and the pair of regulatory members in a state that the right part of the regulatory members is shifted in a direction shown by an arrow depicted in a dotted line.

As shown in these figures, the pair of regulatory members 110 have regulatory pieces 180 disposed at predetermined intervals so as to protrude toward the opening 110A. In this embodiment, the regulatory pieces 180 are disposed at two locations along the bill conveying direction of each regulatory member 110. Since the presser plate 115 reciprocates in the opening 110A of the pair of regulatory members 110 as mentioned above, notches 115C for preventing interference with the regulatory pieces 180 are formed at positions of the presser plate 115 corresponding to the regulatory pieces 180.

By the configuration as described above, when the presser plate 115 occludes the opening 110A, the gaps formed between the opening 110A and the presser plate 115 can be filled with the regulatory pieces 180 such that the gaps can be formed in a difficult shape to draw out a bill therethrough. Further, as the notches 115C are provided in the presser plate 115, interference with the regulatory pieces 180 is effectively prevented when the presser plate 115 is driven to reciprocate, so that bill jam is less likely.

Also, in the configuration provided with the regulatory pieces 180 to fill the gaps formed between the regulatory members 110 and the presser plate 115 as described above, it is preferable that the regulatory pieces 180 are supported rotatably with respect to the respective regulatory members 110 and are configured to be capable of protruding and being retracted from the opening 110A when a bill is made to pass through the opening 110A by the presser plate 115.

Figure 15A:
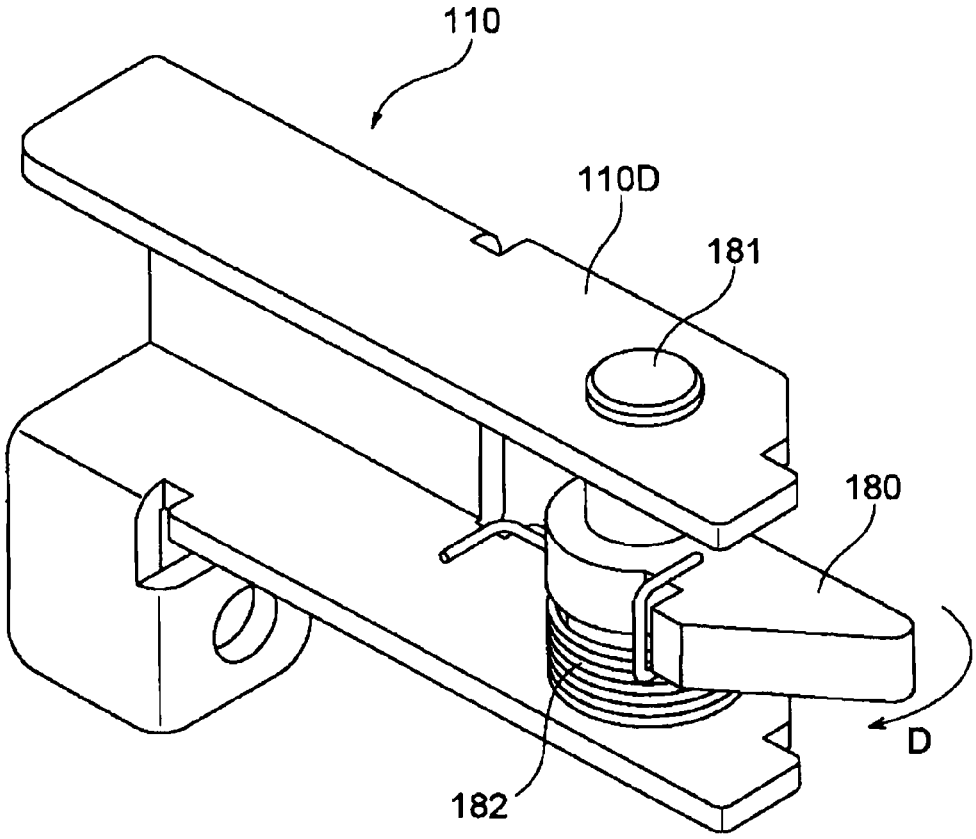
FIG. 15A is a perspective view showing a regulatory piece supported by the regulatory member.

Specifically, as shown in FIGS. 14 and 15A, each regulatory piece 180 is supported rotatably around an axis 181 in a direction as shown by an arrow D (the direction in which a bill passes when the bill is housed) with respect to a frame 110D constituting the corresponding regulatory member 110. Here, a biasing spring 182 is interposed between the regulatory piece 180 and the axis 181 so as to constantly bias the regulatory piece 180 in a direction of protruding from the opening 110A. That is, when a bill is pressed by the presser plate 115, the regulatory piece 180 is rotated by the passing bill in the direction of the arrow D in the figure against the biasing force of the biasing spring 182 and retracts from the opening 110A. When the bill passes through the opening 110A, the regulatory piece 180, in the state of being retracted from the regulating member 110, is rotated by the biasing force of the biasing spring 182 to the position of closing the gap between the presser plate 115 and the regulatory member 110 as shown in FIGS. 14 and 15. The above-mentioned biasing spring 182 is provided as being winded around the axis 181 as a torsion coil spring or a torsion spring, and one end of the coil spring is fixed to the frame 110D as the other end thereof is fixed to the regulatory piece 180 provided rotatably around the axis 181 such that the biasing spring 182 provide a biasing force caused by a rewinding torsional force.

As described above, when the bill is pressed by the presser plate 115 so as to hit and contact the regulatory pieces 180, the regulatory pieces 180 thus rotate and retract from the opening 110A such that it is possible to prevent damages of the bill. That is, the regulatory piece 180 having a wedge shape with a round front edge comprises a circular opening disposed on a back part, through which the axis 181 passes, such that the regulatory piece 180 is rotatable around the axis 181. The above-mentioned axis 181 is provided toward the regulatory member 110 side and backward from the opening 110A, and the front edge of the regulatory piece 180 protrudes into the opening 110A and a vertical side face to be a base face of the wedge shape is faced to the presser plate driving mechanism 120 side such that the regulatory piece 180 is biased toward the presser plate driving mechanism 120 side by the torsional force. Then, the bill pressed by the presser plate 115 hits and pushes the vertical side face toward the placing plate 105 side such that the regulatory piece 180 is turned against the torsional biasing force in the arrow D direction until such a rotational position as the regulatory piece 180 may point the placing plate 105 side. Therefore, the regulatory piece 180 is moved outside the opening 110A and does not appear in a plan view as being retracted. Here, the torsional biasing force is as high as in such a level to spring back the regulatory piece 180 at a position protruding into the opening 110A and it is preferable that it is as low as in such a level not to cause damages of the bill when the regulatory piece 180 is turned.

Also, as the regulatory piece 180 is supported rotatably around the axis 181, the regulatory piece 180 is arranged in a state that a movement thereof in a rotational direction opposite to the bill-passing direction (the arrow D direction) is regulated. That is, the regulatory piece 180 is arranged in a state that it protrudes into the opening 110A as shown in FIGS. 14 and 15A and a rotational movement thereof in a direction opposite to the arrow D direction is regulated by a stopper (not shown) in such a state.

Figure 15B:
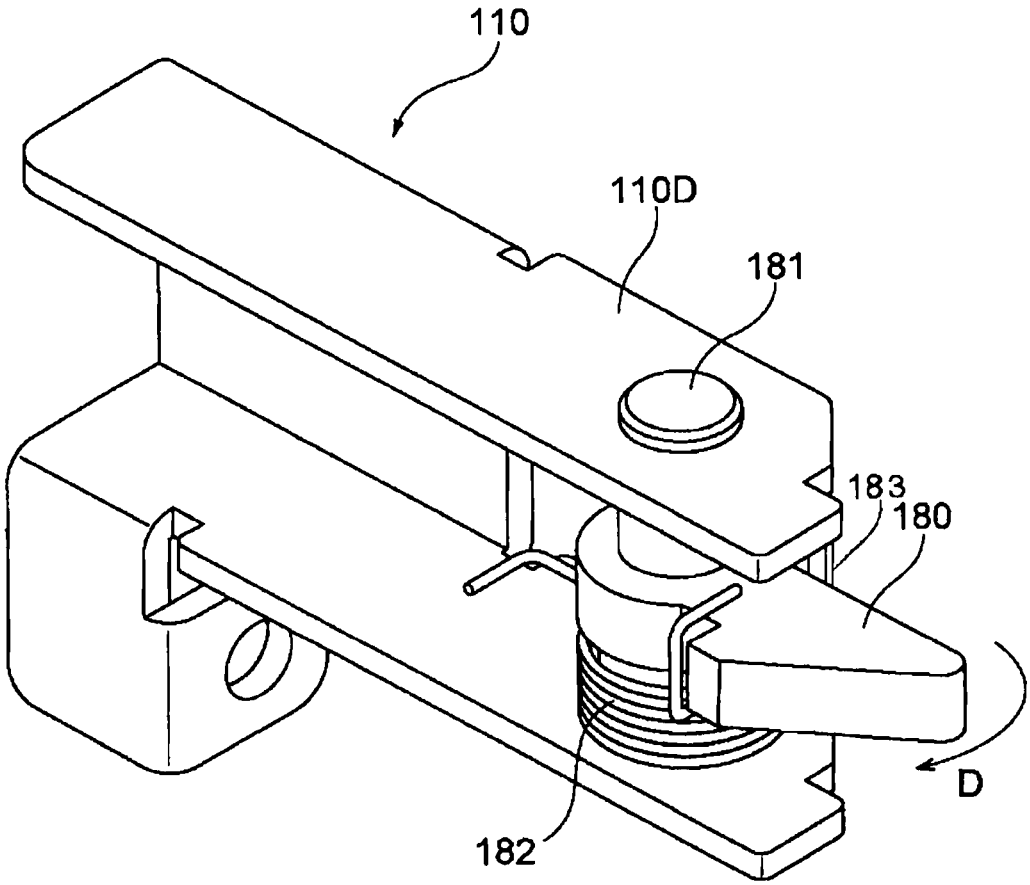
FIG. 15B is a perspective view showing a regulatory piece supported by a regulatory member in another embodiment.

As described above, by regulating the rotation of the regulatory piece 180 in the direction opposite to the bill receiving direction in the opening 110A, an action extracting a bill having been stacked on the placing plate 105 can be prevented more reliably. FIG. 15B shows another embodiment in which a stopper 183 to stop the biasing force by the biasing spring 182 of the regulatory piece 180 is provided. The stopper 183 extends from an upper part and a lower part of the frame 110D as a thin plate and is fixed thereto. The stopper 183 stops the movement in the direction opposite to the arrow D direction of the front edge of the regulatory piece 180.

Figure 16:
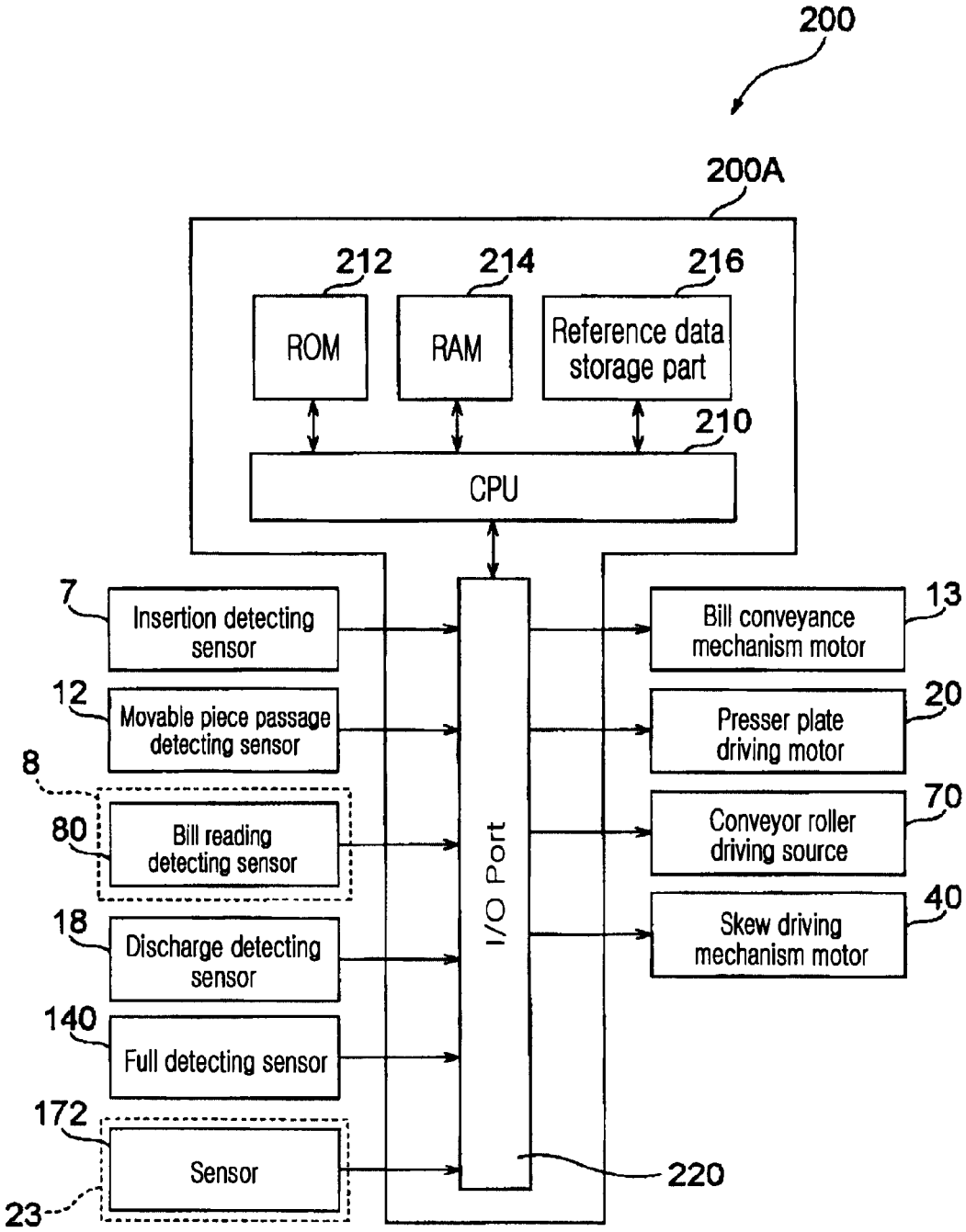
FIG. 16 is a block diagram showing a configuration of control means for controlling driving of the bill processing apparatus.
Figure 17:
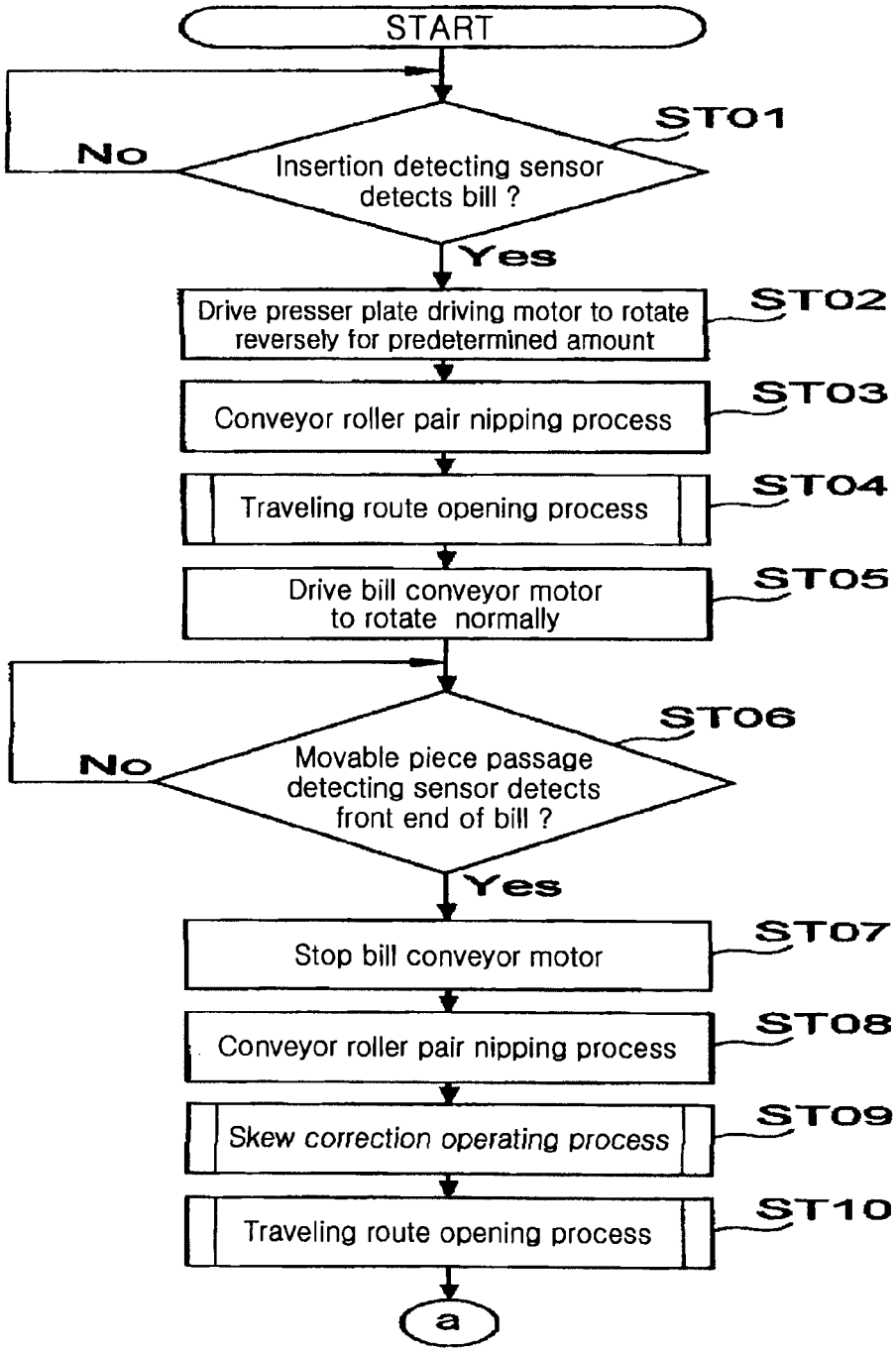
FIG. 17 shows a flowchart (part one) illustrating processing operations for processing a bill in the bill processing apparatus of this embodiment.
Figure 18:
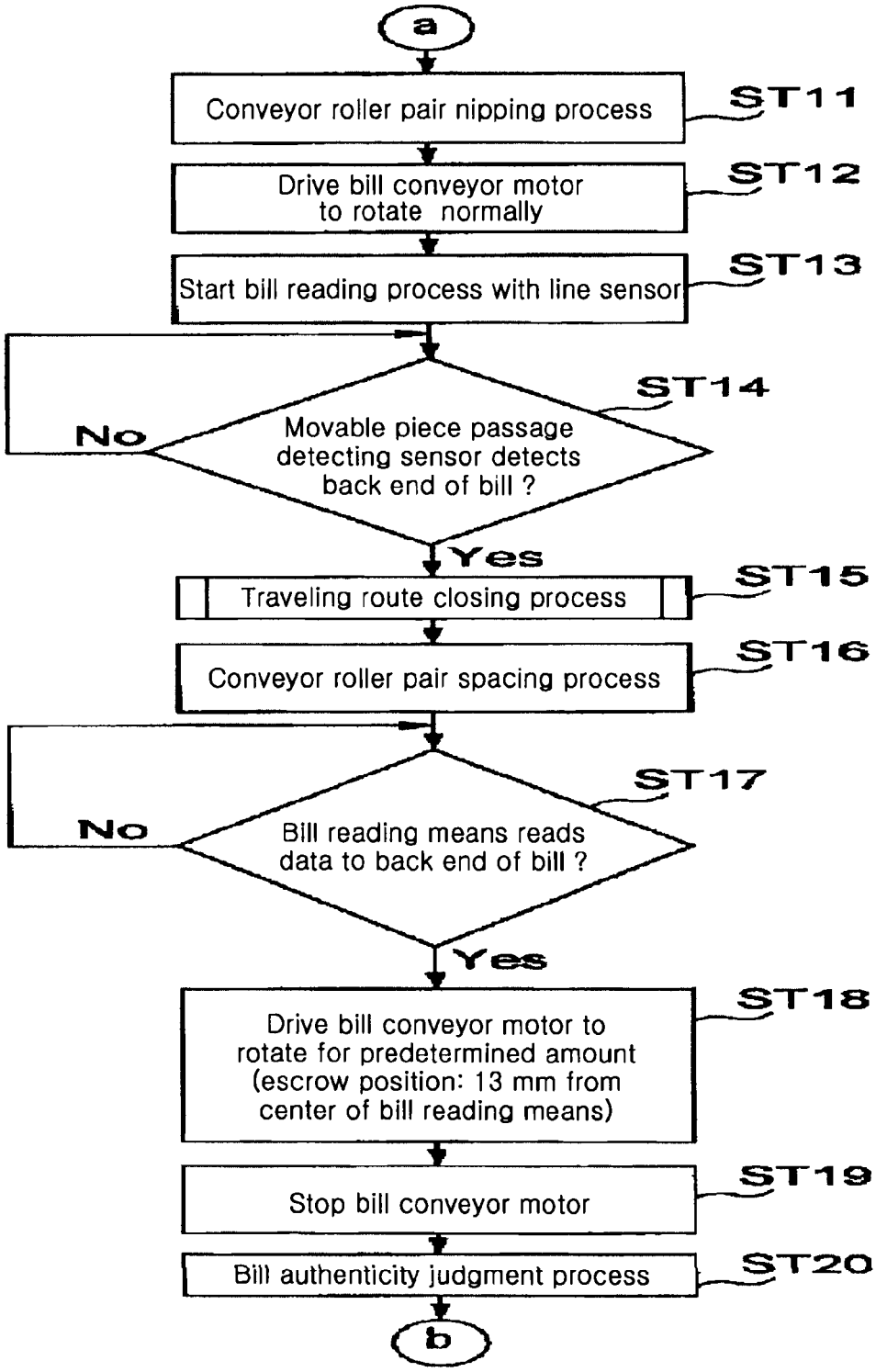
FIG. 18 shows a flowchart (part two) illustrating processing operations for processing the bill in the bill processing apparatus of this embodiment.
Figure 19:
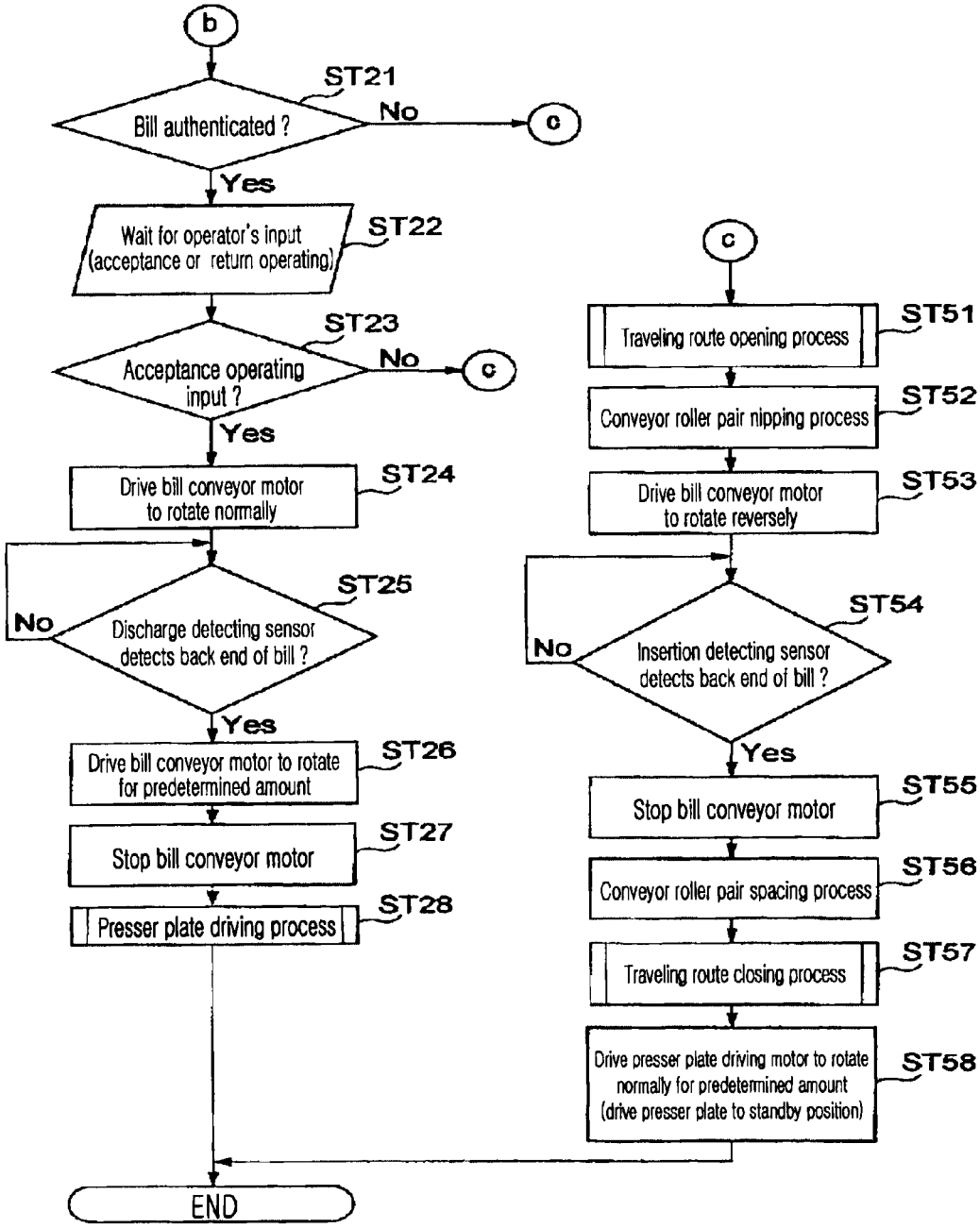
FIG. 19 shows a flowchart (part three) illustrating processing operations for processing the bill in the bill processing apparatus of this embodiment.
Figure 20:
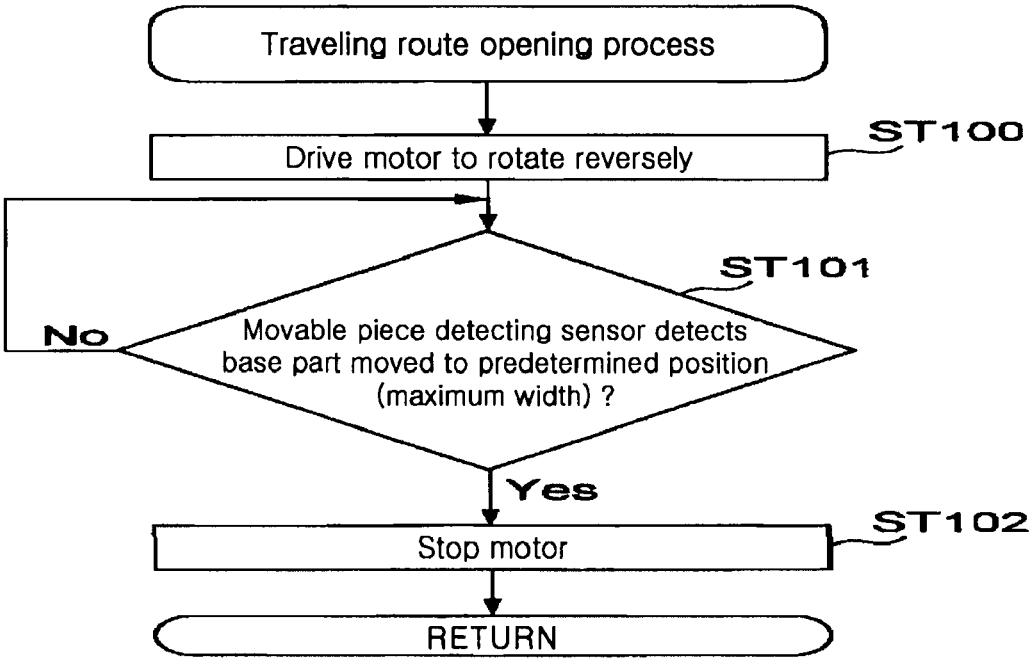
FIG. 20 shows a flowchart illustrating processing operations of a traveling route opening process.

Next, control means for controlling the driving of the above-described bill processing apparatus will be explained in reference to FIG. 16.

The control means 200 comprises a control circuit board 200A that controls the operations of the above-described respective drive units, and a CPU (Central Processing Unit) 210 constituting bill identification means, a ROM (Read Only Memory) 212, a RAM (Random Access Memory) 214, and a reference data storage part 216 are mounted on the control circuit board.

In the ROM 212, various types of programs such as operation programs for the respective drive units such as the motor 13 that drives the above-described bill conveyance mechanism, the motor 20 that drives the presser plate, the driving source 70 that drives the conveyor roller 14A to contact/be spaced from the conveyor roller 14B, the motor 40 to drive the skew driving mechanism 10; an authenticity judgment program for the bill read by the bill reading means 8; and permanent data are stored. The CPU 210 generates control signals according to the programs stored in the ROM 212, carries out the input and output of the signals with respect to the respective drive units via an I/O port 220, and controls the driving of the respective drive units.

Further, detection signals from the insertion detecting sensor 7, the movable piece passage detecting sensor 12, the discharge detecting sensor 18, the full detecting sensor 140, and the sensor 172 constituting a part of the detection means 23 capable of detecting the position of the presser plate 115 are to be input to the CPU 210 via the I/O port 220, and the driving of the respective drive units is controlled on the basis of these detection signals.

Further, data and programs used for the operation of the CPU 210 are stored in the RAM 214, and reference data used for the performance of a bill authenticity judgment, for example, various types of data acquired from all the printing areas of the legitimate bill (such as data about contrasting density and data about transmitted light or reflected light when the bill is irradiated with infrared ray) are stored as reference data in the reference data storage part 216. In addition, the reference data is stored in the dedicated reference data storage part 216. However, the data may be stored in the ROM 212.

Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216 such that a bill authenticity judgment process is executed.

In addition, the control means 200 that controls the operation of the bill processing apparatus is implemented on one control circuit board 200A as mentioned above. However, the control means 200 may be implemented in a distributed manner on separate control circuit boards in accordance with respective functions.

Next, the bill processing operation in the bill processing apparatus 1 executed by the control means 200 will be described with reference to the flowcharts of FIGS. 17 to 23.

When an operator inserts a bill into the bill insertion slot 5, the conveyor roller pair (14A and 14B) installed in the vicinity of the bill insertion slot is in a state that the rollers are spaced from each other in an initial stage (refer to ST16 and ST56 to be described later). Further, with respect to the presser plate 115, as shown in FIGS. 7 and 8, the pair of link members 115*a*, 115*b* driving the presser plate 115 are positioned in the press standby part 108, and the pair of link members 115*a*, 115*b* prevent the bill from being conveyed into the press standby part 108 from the receiving port 103 (refer to ST134 to be described later). That is, in this state, the presser plate 115 is brought into the opening 110A formed between the pair of regulatory members 110 such that the opening 110A is in an occluded state so as to prevent the bill stored in the bill housing part from being drawn out.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST15 and ST57 to be described later) so as to prevent the bill from being drawn out in the initial stage.

When the above-described pair of conveyor rollers (14A and 14B) are in the initial state, the operator easily insert a wrinkled bill into the bill insertion slot 5. Then, when the insertion detecting sensor 7 detects the insertion of the bill (ST01), the driving motor 20 of the above-described presser plate 115 is driven to rotate reversely for a predetermined amount (ST02) to move the presser plate 115 to the initial position. That is, the presser plate 115 is in a state of being moved and remaining in the opening 110A and it is so arranged that a bill cannot pass through the opening 110A until the insertion of a bill is detected by the insertion detecting sensor 7.

When the presser plate 115 is moved to the initial position, the press standby part 108 is arranged in an open state (see FIGS. 9 and 10) and the bill can be conveyed into the inside of the bill housing part 100. That is, by driving the motor 20 to rotate reversely for a predetermined amount, the presser plate 115 is moved from the standby position to the initial position via the main body side gear train 21 and the presser plate driving mechanism 120 (the housing part side gear train 124, the rack 122A formed on the movable member 122, and the link members 115*a*, 115*b*).

Further, the above-described driving source 70 is driven to move the upper conveyor roller 14A to contact the lower conveyor roller 14B. In accordance therewith, the inserted bill is held between the pair of conveyor rollers (14A and 14B) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 20 (ST100). At this time, when it is detected that the pair of movable pieces 10A have moved to the predetermined positions (the maximum open width positions) by the movable piece detecting sensor that detects positions of the pair of movable pieces 10A (ST101), the driving operation to rotate the motor 40 reversely is stopped (ST102). This traveling route opening process allows the bill to enter between the pair of movable pieces 10A. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is carried into the inside of the apparatus by the conveyor roller pair (14A and 14B), and when the movable piece passage detecting sensor 12 installed on the downstream side from the skew correction mechanism 10 detects the front end of the bill, the bill conveyor motor 13 is stopped (ST06 and ST07). At this time, the bill is located between the pair of movable pieces 10A constituting the skew correction mechanism 10.

Next, the above-described driving source 70 is driven to allow the conveyor roller pair (14A and 14B) holding the bill therebetween to become apart from each other (ST08). At this time, the bill is in a state that no load is applied.

Figure 21:
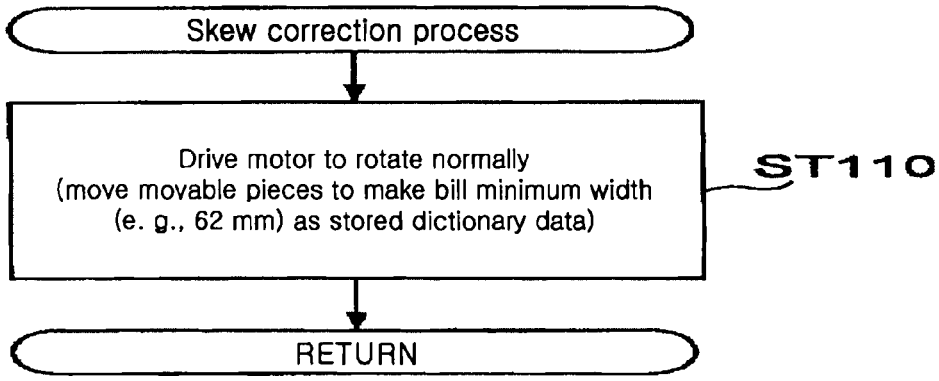
FIG. 21 shows a flowchart illustrating processing operations of a skew correction operating process.
Figure 22:
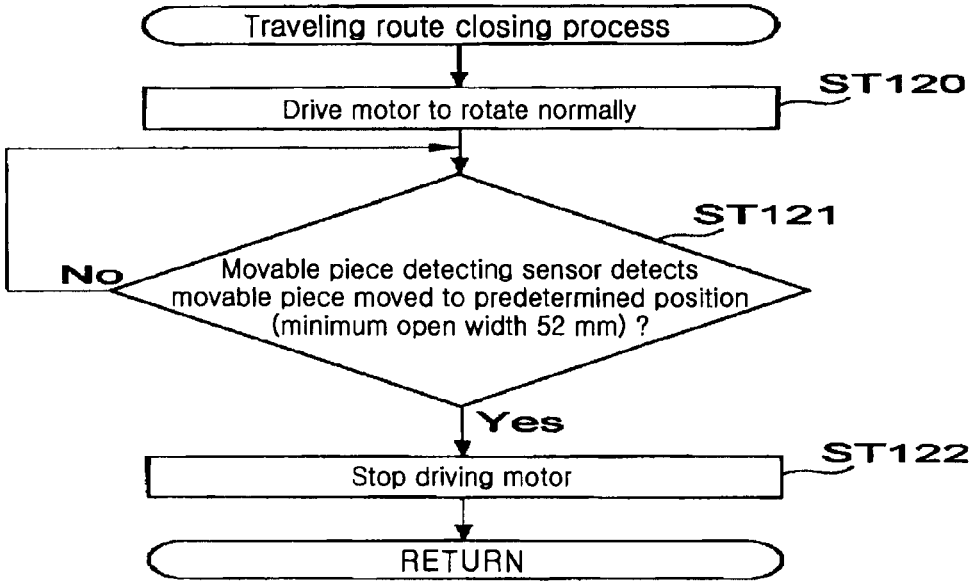
FIG. 22 shows a flowchart illustrating processing operations of a traveling route closing process.

Then, a skew correction operating process is executed as the bill remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 21, the motor 40 described above is driven to rotate normally to move the pair of movable pieces 10A in respective directions such that the pair of movable pieces 10A get closer with each other (ST110). The movement of the movable pieces is continued until the interval becomes the minimum width (example; width of 62 mm) of the bill registered in the reference data storage part in the control means, and the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 20).

Next, the above-described driving source 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to carry the bill into the inside of the apparatus, and when the bill passes through the bill reading means 8, a bill reading process is executed (ST12 and ST13).

Then, when the bill to be carried passes through the bill reading means 8, and the back end of the bill is detected by the movable piece detecting sensor 12 (ST14), a process for closing the bill traveling route 3 is executed (ST15). In this process, first, as shown in the flowchart of FIG. 21, after the back end of the bill is detected by the movable piece detecting sensor 12, the above-described motor 40 is driven to rotate normally to move the pair of movable pieces 10A in respective directions such that the pair of movable pieces 10A get closer with each other (ST120). Next, when it is sensed by the movable piece detecting sensor that the movable pieces 10A move to the predetermined positions (minimum open width positions: for example, width of 52 mm) (ST121), the driving operation of the normal rotation of the motor 40 is stopped (ST122).

With this traveling route closing process, the pair of movable pieces 10A are moved to the minimum open width positions (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In addition, when the movable piece detecting sensor as described above detects the movement of the movable pieces 10A in this state, it may be considered that the operator is committing some fraudulent activities such that a predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may flash, or without activating a process for input acceptance (ST22) input by another operator thereafter, a process in which a discharge operation or the like is forcibly carried out may be executed. Or, appropriate processes such as canceling the operation of the bill processing apparatus (for example, a process for stopping the processing, a process for discharging the bill, and the like) and the like may be executed.

Further, in succession to the traveling route closing process described above (ST15), a conveyor roller pair spacing process is executed such that the driving source 70 is driven to make the conveyor roller pair (14A, 14B) having been in a state capable of nipping and holding the bill therebetween separate from each other (ST16). By executing the conveyor roller pair spacing process, even if the operator additionally inserts (double insertion) another bill by mistake, the bill is not subject to a feeding operation by the conveyor roller pair (14A, 14B) and hits front ends of the pair of movable pieces 10A in a closed state according to ST15 such that it is possible to reliably prevent the operation of bill double-insertion.

Along with the bill traveling route closing process as mentioned above, when the bill reading means 8 reads the data up to the back end of the bill, the bill conveyor motor 13 is driven for a predetermined amount and leave the bill stopped at a predetermined position (escrow position; position where the bill is carried toward the downstream by 13 mm from the center position of the bill reading means 8), and at this time, a bill authenticity judgment process is executed by the control means 200 (ST17 to ST20).

In the bill authenticity judgment process at ST20 as described above, when the bill is judged as a legitimate bill (ST21; Yes), an input from the operator is received (ST22). This input corresponds to an acceptance operation in which the operator presses an acceptance button in order to accept provision of services (for example, in the case of a gaming device, an acceptance process accompanied by start of a game), and a return operation in which the operator presses a return button in order to execute a process for returning the inserted bill.

Then, when an operation to accept the provision of various types of services is input (ST23; Yes), the bill conveyor motor 13 is consecutively driven to rotate normally to convey the bill in this state toward the bill housing part 100 (ST24). While the bill is conveyed, the bill conveyor motor 13 is driven to rotate normally until the back end of the bill is detected by the discharge detecting sensor 18 (ST25), and after the back end of the bill is detected by the discharge detecting sensor 18, the bill conveyor motor 13 is driven to rotate normally by the predetermined amount (ST26 and ST27).

The process for driving the bill conveyor motor 13 to rotate normally in ST26 and ST27 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide the bill stably to the press standby part 108. That is, by further driving the bill conveyor motor 13 to rotate normally for a predetermined amount after the back end of the bill is detected by the discharge detecting sensor 18, the pair of belts 150 contact the bill conveyed-in and are driven in the bill feeding direction so as to guide the bill in a stable state to the press standby part 108. In this case, the bill is guided along the guide faces 160*a* of the guide members 160 formed along the bill conveying-in direction from the receiving port 103. When the bill is conveyed in the press standby part 108, the bill is to be conveyed to the appropriate pressing position without shifting to either side partly because the pair of belts 150 contact the bill. A pressing process is conducted such that the bill is bent in a bilaterally symmetric manner by the presser plate 115 and passes through the opening 110A between the pair of regulatory members 110.

Then, after the above-described bill conveyor motor 13 is stopped, the process for driving the presser plate 115 is executed (ST28) such that the bill is placed on the placing plate 105.

Figure 23:
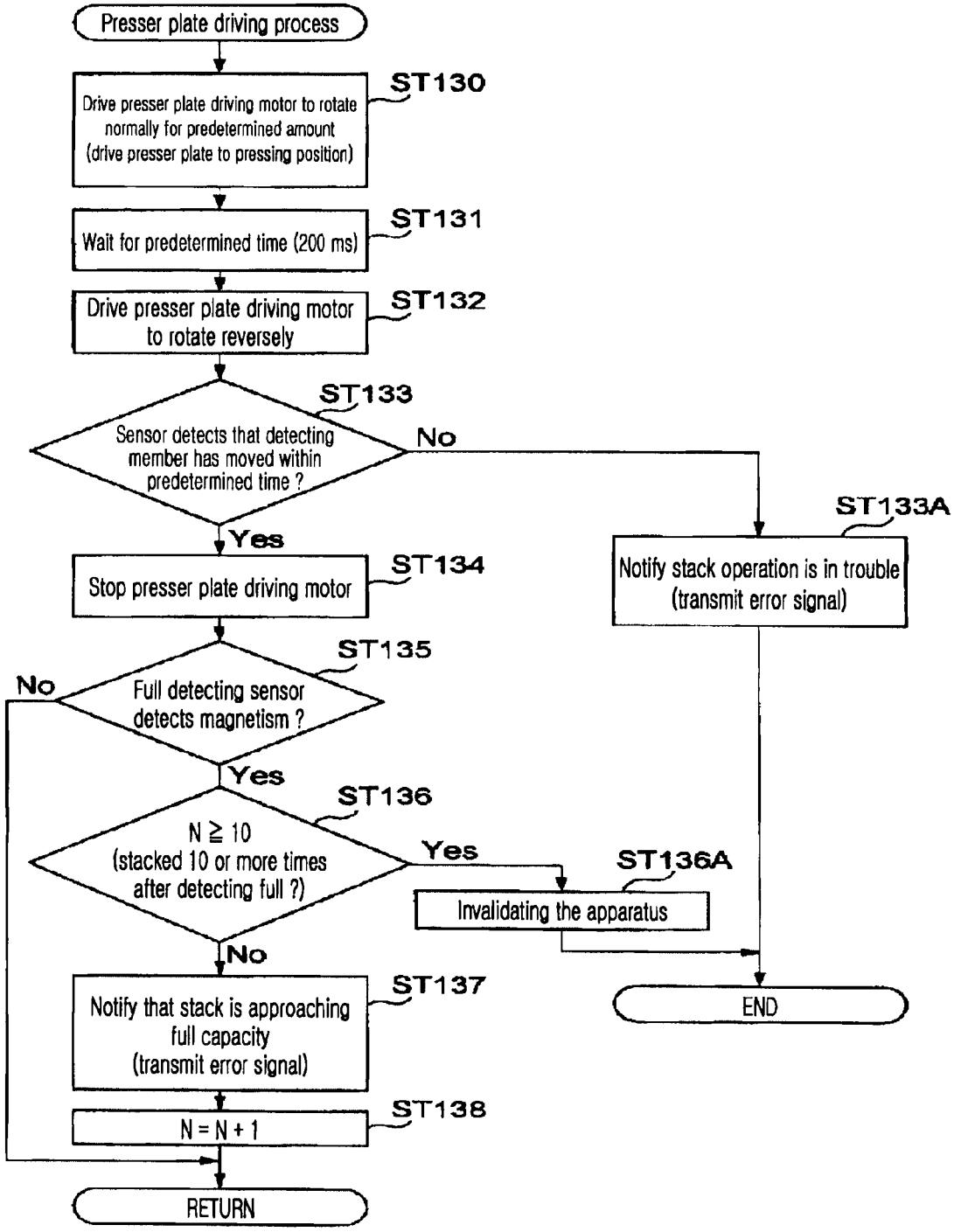
FIG. 23 shows a flowchart illustrating processing operations of a presser plate driving process.

The process for driving the presser plate 115 is executed in accordance with the flowchart as shown in FIG. 23. First, the driving motor 20 of the presser plate 115 is driven to rotate normally for a predetermine amount to move the presser plate 115 staying at the initial position in the above ST02 until it gets to the pressing position (ST130). With respect to the amount of driving to rotate normally the motor 20, if the motor 20 is composed of a DC motor, a predetermined amount of rotation can be set such that pulses are generated by utilizing, for example, an encoder and the number of the pulses is measured. That is, by driving the driving motor 20 to rotate normally for a predetermined amount, the presser plate 115 is moved from the initial position to the pressing position via the main body side gear train 21 and the presser plate driving mechanism 120 (the housing part side gear train 124, the rack 122A formed on the movable member 122, and the link members 115*a* and 115*b*).

According to the movement of the presser plate 115, in a way as shown from FIG. 10 to FIG. 12, the bill in the press standby part 108 passes through the opening 110A between the pair of regulatory members 110 so as to be deflected in a U-shape in a laterally symmetrical manner, and the bill is finally pressed onto the placing plate 105. In this case, since the bill is conveyed to the appropriate pressing position without leaning to either side by the pair of belts 150 as described above, even if the presser plate 115 is moved, the bill is placed on the placing plate 105 stably without jamming or the like between the presser plate 115 and the pair of regulatory members 110.

When the presser plate 115 is moved to the pressing position, the presser plate 115 is processed to wait (ST131) for a predetermined time (200 ms) at the pressing position so as to place the bill stably on the placing plate 105, and thereafter, the driving motor 20 of the presser plate 115 is driven to rotate reversely (ST132). As the motor 20 is driven to rotate reversely, the presser plate 115 is driven to move from the pressing position to the standby position as shown in FIGS. 7 and 8, and when the sensor 172 detects a detecting part 170*a* of the detecting member 170 (when it is detected by the sensor 172 that the presser plate 115 has moved from the pressing position to the standby position), the driving of the motor 20 is stopped, and the presser plate 115 is stopped at the standby position (ST133: Yes, ST134).

As described above, when the presser plate 115 remains at the standby position, the presser plate is positioned in the opening 110A between the pair of regulatory members such that the apparatus is arranged in a state that a bill placed on the placing plate 105 cannot be drawn out from the receiving port 103 side.

In addition, if the sensor 172 does not detect that the presser plate 115 has moved from the pressing position to the standby position within a predetermined time, it is considered that something is wrong with the stack operation, and the signal expressing that something is wrong with the stack operation (an error signal) is transmitted to an external device, annunciation means, or the like (ST133; No, ST133A).

Then, after the presser plate 115 is moved from the pressing position to the standby position, in a case where the full detecting sensor 140 described above detects magnetism from the magnet provided to the rear surface of the placing plate 105 (ST135; Yes), it is informed that the bill housing part 100 approaches to the limit capacity (ST136: No, ST137). This informing is to be repeated under the condition of a predetermined number of times (four times in this embodiment) or less after the full detecting sensor 140 detects the magnetism (ST138), thereby enabling an administrator to exchange the bill housing part 100 before the bill housing part 100 is full with the bills.

Further, after the full detecting sensor 140 detects the magnetism, when it is detected that ten or more times the bill stack operation is repeated without exchanging the bill housing part 100 (ST136; Yes), a process of invalidating the apparatus is executed in order for bills not to be further inserted therein (ST136A). With respect to this invalidation process, for example, a process of stopping driving the bill conveyor mechanism described above may be performed in order not to convey the bill inside even if a user inserts a bill into the bill insertion slot.

In the process of ST21, when the bill is judged as a non-legitimate bill or the operator presses the return button (ST23; No), a traveling route opening process is executed (ST51, refer to ST100 to ST102 of FIG. 20). After that, the bill conveyor motor 13 is driven to rotate reversely such that the bill waiting at the escrow position is conveyed toward the bill insertion slot 5 (ST52 and ST53). Then, when the insertion detecting sensor 7 senses the back end of the bill to be returned toward the bill insertion slot 5, the driving to reversely rotate the bill conveyor motor 13 is stopped, and above-described driving source 70 is driven to make the conveyor roller pair (14A and 14B) in a state of nipping and holding the bill therebetween separate from each other (ST54 to ST56). After that, the traveling route closing process is executed (ST57, and from ST120 to ST122 in FIG. 22) and the driving motor 20 of the presser plate 115 is driven to rotate normally (ST58) such that the presser plate 115 positioned at the initial position is driven to move to the standby position, and then a series of processes are completed.

In the bill processing apparatus in accordance with the above-described configuration, the opening 110A disposed between the pair of regulatory members 110 in the bill housing part 100, through which a bill passes, is caused to be an occluded state by the presser plate 115 until the bill is inserted in the bill insertion slot 5 such that the bill loaded and housed on the placing plate 110 of the bill housing part 100 may be prevented from being drawn out by a fraudulent activity or the like.

The embodiment of the present invention has been described above. However, the present invention is not limited to the above-described embodiment, and various modifications can be implemented. In the present invention, it suffices that the apparatus is so configured that the presser plate 115 is moved inside the opening 110A such that a bill stacked and housed on the placing plate 110 is prevented from being drawn out via the opening 110A until a bill is inserted into the bill insertion slot 5 (until the insertion of a bill into the bill processing apparatus is performed), and the driving sources driving the above-described various driving members or power transmission mechanisms from the driving sources are appropriately modified.

Also, in regard to the presser plate 115 in the state of moving inside the opening 110A, it suffices that at least a part of the presser plate portion is positioned inside the opening 110A and a surface portion thereof may be flush with surfaces of the regulatory members 110 or may be protruded slightly from the surfaces or may be positioned slightly inside the opening 110A.

According to the bill processing apparatus having the above-described configuration, since the opening in the bill housing part is caused to be in an occluded condition by the presser plate until a bill is inserted, it becomes difficult to draw out the bill loaded and housed in the bill housing part by means of a fraudulent activity or the like.

Further, the opening is disposed in the regulatory members which regulate a movement of a bill housed in the bill housing part, a regulatory piece protruding toward the opening is disposed on the regulatory members, and the presser plate has a notch at a position corresponding to that of the regulatory piece.

In such a configuration, when the presser plate occludes the opening, a gap formed between the opening and the presser plate can be filled by the regulatory piece such that a gap shape may be so formed that it would be difficult to draw out the bill.

Further, the regulatory piece is rotatably supported by the regulatory member and is protrusible and retractable from the opening when a bill is made to pass through the opening by the presser plate.

In such a configuration, when the bill is pressed by the presser plate, the bill hits the regulatory piece such that the regulatory piece is turned and retracted from the opening so that damages of the bill can be prevented.

Further, the rotation of the regulatory piece is regulated in a direction opposite to a bill receiving direction into the opening.

In such a configuration, the rotation of the regulatory piece is regulated in the direction opposite to the bill receiving direction into the opening such that an action of drawing out a bill can be more reliably prevented.

As described above, the bill processing apparatus which may prevent extraction of the bill housed in the bill housing part can be provided.

The present invention can be incorporated into various types of apparatuses providing products and services by inserting a bill thereinto for example.

What is claimed is:

1. A bill processing apparatus comprising:

an insertion slot through which a bill is inserted;

a bill housing part housing the bill having been inserted from the insertion slot;

an opening receiving the bill into the bill housing part;

a pair of regulatory members defining the opening;

a regulatory piece provided to one of the regulatory members, protruding toward the opening, and having a lateral dimension shorter than a length of the bill so as to contact the bill only partially on a side edge of the bill; and a presser plate configured to pass through the opening and housing the bill in the bill housing part, the presser plate including a notch disposed at a position corresponding to a position of the regulatory piece so as to pass the opening without interference with the regulatory piece, wherein:

the regulatory piece is rotatably supported by the one of the regulatory members, and is protrusible and retractable from the opening when the bill passes through the opening by the presser plate; and a sensor to detect the bill inserted from the insertion slot is provided such that passage of the bill through the opening is regulated by moving the presser plate until the sensor detects insertion of the bill.

2. The bill processing apparatus according to claim 1, wherein a rotation of the regulatory piece is regulated in a direction opposite to a receiving direction into the opening.

3. The bill processing apparatus according to claim 1, wherein the presser plate is pivotally connected to a pair of link members constituting a presser plate driving mechanism such that the passage of the bill through the opening is regulated by the pair of link members.

4. A bill housing part utilized in a bill processing apparatus wherein the bill processing apparatus comprises:

a receiving port from which a bill is conveyed;

a press standby part in which the bill conveyed from the receiving port waits;

a pair of regulatory members provided to the press standby part so as to separate the press standby part from a space in which the bill is housed;

an opening communicating with the space in which the bill is housed, the opening being defined between the pair of regulatory members;

a regulatory piece provided to one of the regulatory members, protruding toward the opening, and having a lateral dimension shorter than a length of the bill so as to contact the bill only partially on a side edge of the bill;

a placing plate on which the bill is stacked in the space in which the bill is housed; and a presser plate to push the bill waiting in the press standby part to pass through the opening such that the bill is pressed onto the placing plate, the presser plate including a notch disposed at a position corresponding to a position of the regulatory piece so as to pass the opening without interference with the regulatory piece, wherein:

the regulatory piece is rotatably supported by the one of the regulatory members, and is protrusible and retractable from the opening when the bill passes through the opening by the presser plate;

the presser plate is moveable to one of an initial position, a standby position, and a pressing position by an external drive;

the housing part becomes in an acceptable condition of the bill from the insertion slot when the presser plate moves to the initial position;

the housing part becomes in an unacceptable condition of the bill from the insertion slot when the presser plate moves to the standby position; and the housing part becomes in an unacceptable condition of the bill from the insertion slot and the placing plate becomes in a condition to be pushed when the presser plate moves to the pressing position.

5. The bill housing part according to claim 4 further comprising:

elastic members to bias the respective regulatory pieces to protrude into the opening; and stoppers provided to the respective regulatory pieces such that movements of the regulatory pieces by biasing force are seized.

6. The bill processing apparatus according to claim 4, wherein the presser plate is pivotally connected to a pair of link members constituting a presser plate driving mechanism such that passage of the bill through the opening is regulated by the pair of link members.

* * * * *